US009098990B2

(12) United States Patent
Rasband et al.

(10) Patent No.: US 9,098,990 B2
(45) Date of Patent: Aug. 4, 2015

(54) MOBILE RETAIL PERIPHERAL PLATFORM FOR HANDHELD DEVICES

(71) Applicant: Tyco Fire & Security GmbH, Neuhausen Am Rheinfall (CH)

(72) Inventors: Paul B. Rasband, Lantana, FL (US); Melwyn Sequeira, Plantation, FL (US); Hubert A. Patterson, Boca Raton, FL (US); Ronald B. Easter, Parkland, FL (US)

(73) Assignee: Tyco Fire & Security GmbH, Neuhasen am Rheinfall (CH)

( * ) Notice: Subject to any disclaimer, the term of this patent is extended or adjusted under 35 U.S.C. 154(b) by 186 days.

(21) Appl. No.: 13/903,282

(22) Filed: May 28, 2013

(65) Prior Publication Data

US 2014/0085089 A1 Mar. 27, 2014

Related U.S. Application Data

(60) Provisional application No. 61/704,061, filed on Sep. 21, 2012.

(51) Int. Cl.
*G08B 13/24* (2006.01)

(52) U.S. Cl.
CPC ..... *G08B 13/246* (2013.01)

(58) Field of Classification Search
CPC ..... G08B 13/246
USPC ..... 340/572.1
See application file for complete search history.

(56) References Cited

U.S. PATENT DOCUMENTS

| | | | | |
|---|---|---|---|---|
| 5,640,002 | A * | 6/1997 | Ruppert et al. | 235/462.46 |
| 5,942,978 | A * | 8/1999 | Shafer | 340/572.9 |
| 5,955,951 | A * | 9/1999 | Wischerop et al. | 340/572.8 |
| 6,232,870 | B1 * | 5/2001 | Garber et al. | 340/10.1 |
| 8,274,391 | B2 * | 9/2012 | Yang | 340/572.8 |
| 8,368,542 | B2 * | 2/2013 | Yang | 340/572.8 |
| 8,630,908 | B2 * | 1/2014 | Forster | 705/17 |
| 2004/0070507 | A1 * | 4/2004 | Campero | 340/572.9 |
| 2007/0204153 | A1 * | 8/2007 | Tome et al. | 713/164 |
| 2014/0100978 | A1 * | 4/2014 | Forster | 705/21 |
| 2014/0207670 | A1 * | 7/2014 | Matotek et al. | 705/41 |

* cited by examiner

*Primary Examiner* — Brian Zimmerman
*Assistant Examiner* — Bhavin M Patel
(74) *Attorney, Agent, or Firm* — Robert J. Sacco, Esq.; Carol E. Thurstad-Forsyth, Esq.; Fox Rothschild LLP

(57) ABSTRACT

Systems (100) and methods (700) for operating a security tag of an Electronic Article Surveillance ("EAS") system. The methods involve: executing on a mobile Point Of Sale ("POS") device (104) an application operative to control operations of a peripheral device (190) attached to the mobile POS device for facilitating performance of a purchase transaction; receiving, by the mobile POS device a request to detach the security tag from an article; and communicating a message from the mobile POS device to the peripheral device via a first short range communication. The message is configured to cause the peripheral device to perform operations to facilitate a detachment of the security tag from the article. Next, a signal is communicated from the peripheral device to the security tag. The signal causes an actuation of a detachment mechanism of the security tag or a heating of an adhesive disposed on the security tag.

20 Claims, 14 Drawing Sheets

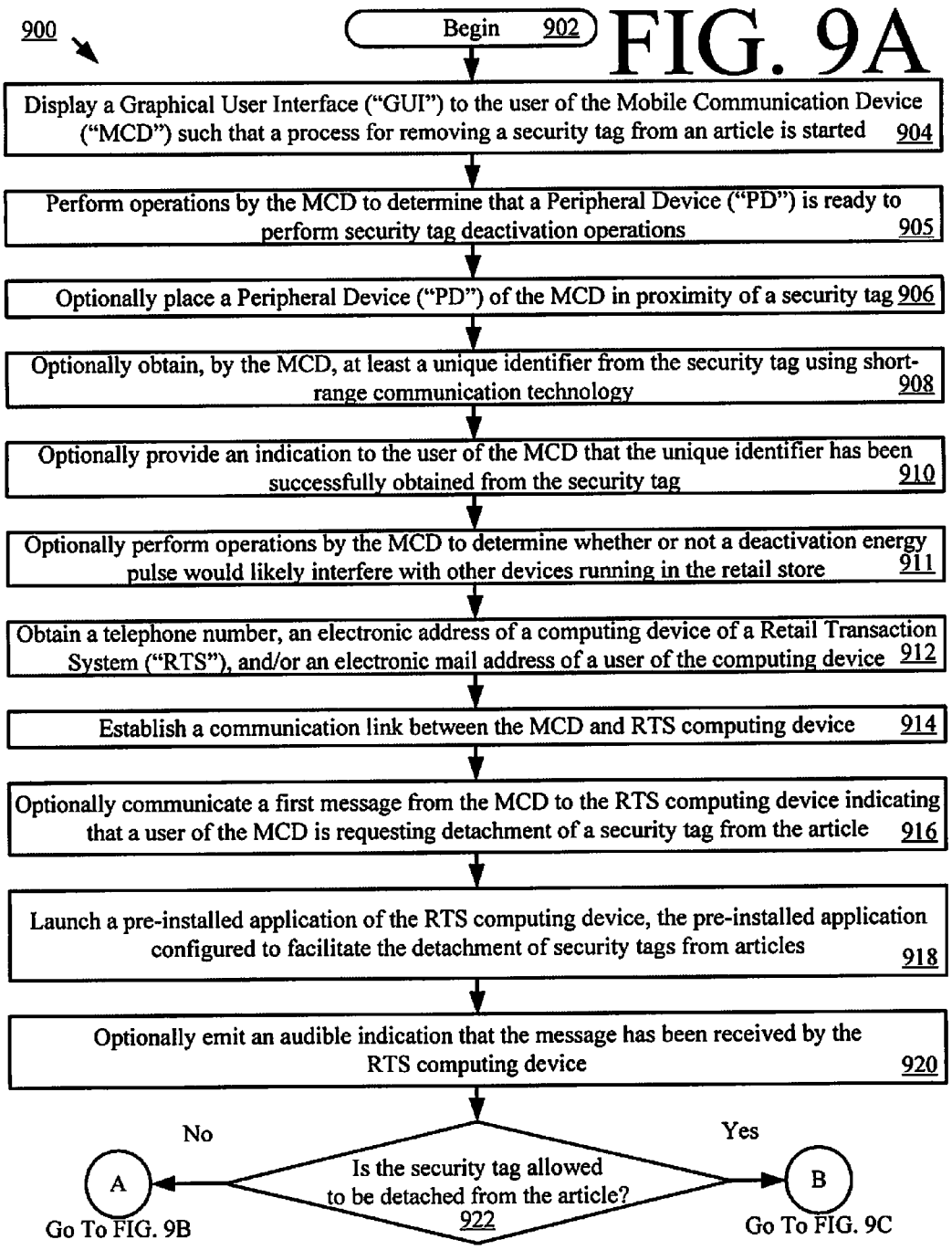
900
Begin 902
FIG. 9A
Display a Graphical User Interface ("GUI") to the user of the Mobile Communication Device ("MCD") such that a process for removing a security tag from an article is started 904
Perform operations by the MCD to determine that a Peripheral Device ("PD") is ready to perform security tag deactivation operations 905
Optionally place a Peripheral Device ("PD") of the MCD in proximity of a security tag 906
Optionally obtain, by the MCD, at least a unique identifier from the security tag using short-range communication technology 908
Optionally provide an indication to the user of the MCD that the unique identifier has been successfully obtained from the security tag 910
Optionally perform operations by the MCD to determine whether or not a deactivation energy pulse would likely interfere with other devices running in the retail store 911
Obtain a telephone number, an electronic address of a computing device of a Retail Transaction System ("RTS"), and/or an electronic mail address of a user of the computing device 912
Establish a communication link between the MCD and RTS computing device 914
Optionally communicate a first message from the MCD to the RTS computing device indicating that a user of the MCD is requesting detachment of a security tag from the article 916
Launch a pre-installed application of the RTS computing device, the pre-installed application configured to facilitate the detachment of security tags from articles 918
Optionally emit an audible indication that the message has been received by the RTS computing device 920
Is the security tag allowed to be detached from the article? 922
No
Yes
A
Go To FIG. 9B
B
Go To FIG. 9C

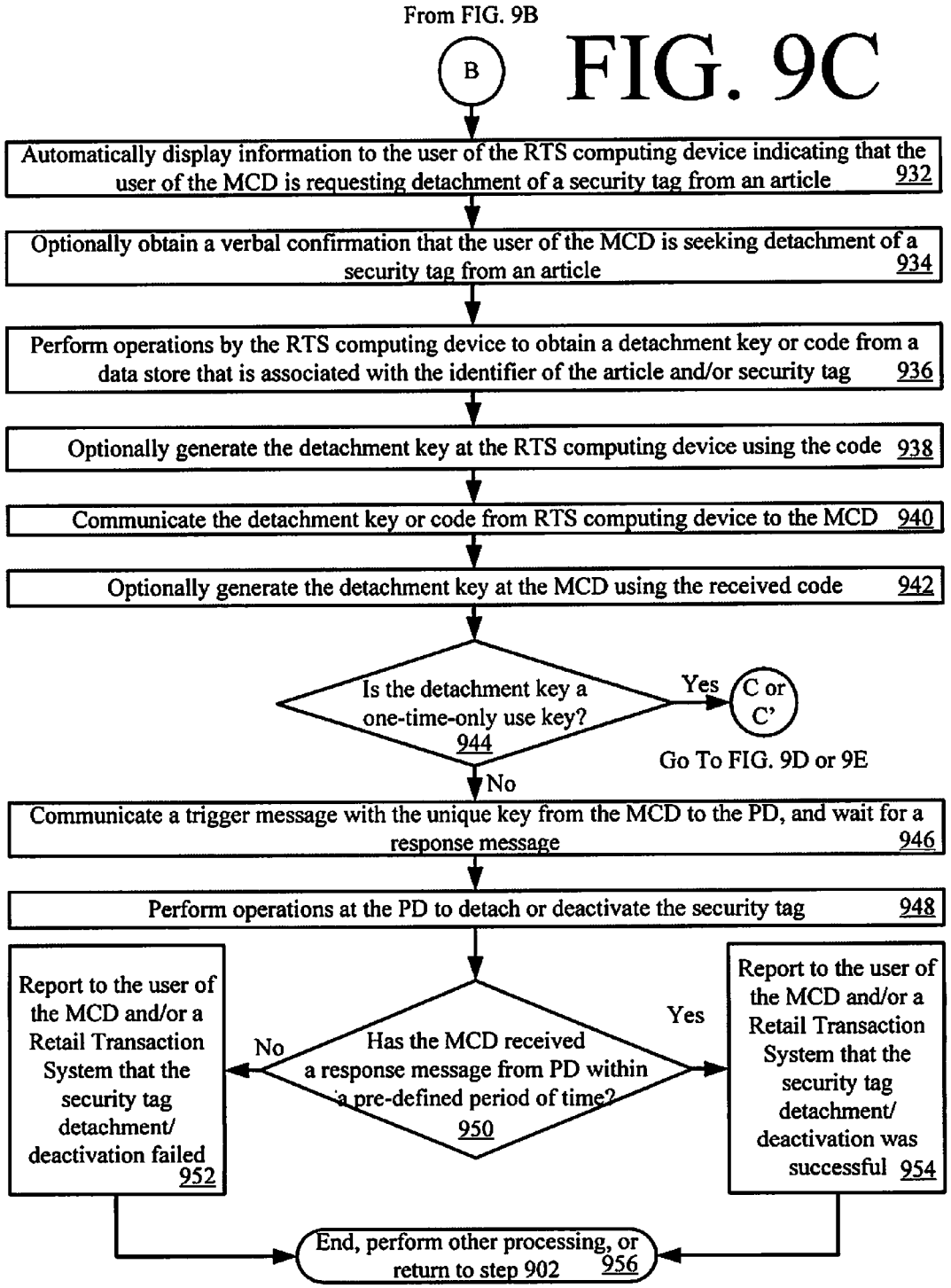
From FIG. 9B
B
FIG. 9C
Automatically display information to the user of the RTS computing device indicating that the user of the MCD is requesting detachment of a security tag from an article 932
Optionally obtain a verbal confirmation that the user of the MCD is seeking detachment of a security tag from an article 934
Perform operations by the RTS computing device to obtain a detachment key or code from a data store that is associated with the identifier of the article and/or security tag 936
Optionally generate the detachment key at the RTS computing device using the code 938
Communicate the detachment key or code from RTS computing device to the MCD 940
Optionally generate the detachment key at the MCD using the received code 942
Is the detachment key a one-time-only use key? 944
Yes
C or C'
Go To FIG. 9D or 9E
No
Communicate a trigger message with the unique key from the MCD to the PD, and wait for a response message 946
Perform operations at the PD to detach or deactivate the security tag 948
Has the MCD received a response message from PD within a pre-defined period of time? 950
No
Report to the user of the MCD and/or a Retail Transaction System that the security tag detachment/ deactivation failed 952
Yes
Report to the user of the MCD and/or a Retail Transaction System that the security tag detachment/ deactivation was successful 954
End, perform other processing, or return to step 902 956

MOBILE RETAIL PERIPHERAL PLATFORM FOR HANDHELD DEVICES

CROSS REFERENCE TO RELATED APPLICATIONS

This application is a non-provisional application of U.S. Provisional Application No. 61/704,061 filed on Sep. 21, 2012, which is herein incorporated in its entirety.

STATEMENT OF THE TECHNICAL FIELD

The inventive arrangements relate to systems and methods for deactivating an Electronic Article Surveillance ("EAS") tag at a mobile Point Of Sale ("POS"). More particularly, the inventive arrangements concern systems and methods for deactivating an EAS tag using a peripheral device of a mobile device (e.g., a mobile phone or computing device).

DESCRIPTION OF THE RELATED ART

A typical EAS system in a retail setting may comprise a monitoring system and at least one security tag or label attached to an article to be protected from unauthorized removal. The monitoring system establishes a surveillance zone in which the presence of security tags and/or labels can be detected. The surveillance zone is usually established at an access point for the controlled area (e.g., adjacent to a retail store entrance and/or exit). If an article enters the surveillance zone with an active security tag and/or label, then an alarm may be triggered to indicate possible unauthorized removal thereof from the controlled area. In contrast, if an article is authorized for removal from the controlled area, then the security tag and/or label thereof can be deactivated and/or detached therefrom. Consequently, the article can be carried through the surveillance zone without being detected by the monitoring system and/or without triggering the alarm.

Currently, there is no convenient way to deactivate an EAS tag using available mobile POS units. Options include: the use of a mobile deactivation unit in addition to a mobile POS unit; the use of a fixed deactivation unit located within a retail store which reduces the mobility of the mobile POS unit; or the use of a fixed deactivation unit located at an exit of a retail store which burdens customers with a post-POS task. None of these options is satisfactory for large scale mobile POS adaption in a retail industry.

Also, there is no general support for Near Field Communication ("NFC") or Radio Frequency Identification ("RFID") data transfer to and from mobile POS units. Even if some manufacturers were to begin implementing NFC functions in some models of mobile POS units, there would still be some mobile POS units which do not support NFC. Such mobile POS units would be excluded from consideration by any retailer requiring NFC support. Furthermore, passive RFID functionality and support is not expected from any of the major handheld device manufactures.

Additionally, the mobile POS units are fragile, and therefore do not meet the level of protection and ruggedization needed for typically rigorous retail store operations. Maintaining the physical security of a mobile POS unit is a challenge which needs to be addressed. Handheld devices and tablets represent a significant capital investment by the retail enterprise and may contain sensitive data of proprietary interest to the retailer. Thus, it is important to prevent the theft of such devices. Suitable solutions for preventing such theft are not currently available in the marketplace.

A related problem deals with finding lost or misplaced mobile retail hardware inside a retail store. Many retail stores are very large. Therefore, a significant amount of employee labor may be required to search for such lost or misplaced retail hardware.

SUMMARY OF THE INVENTION

The present invention concerns systems and methods for operating a security tag of an EAS system. The methods involve executing on a mobile POS device a software application operative to control operations of a peripheral device for facilitating performance of a purchase transaction. Thereafter, the mobile POS device receives a request to detach the security tag from an article. In response to the request, a message is communicated from the mobile POS device to the peripheral device via a first short range communication (e.g., a Bluetooth communication). The message is configured to cause the peripheral device to perform operations to facilitate a detachment of the security tag from the article. Next, a signal is communicated from the peripheral device of the security tag. The signal causes an actuation of a detachment mechanism of the security tag and/or a heating of an adhesive disposed on the security tag.

In some scenarios, the peripheral device may be physically coupled to the mobile POS device. For example, the peripheral device may include an insert space in which the mobile POS device can be at least partially disposed such that the peripheral device may wrap around at least a portion of the mobile POS device. Such a coupling configurations allows the mobile POS device and the peripheral device to be easily carried or worn by a user or vehicle.

In those or other scenarios, the method also involves: obtaining access to a secure area of a retail store by communicating a second short range communication (e.g., a near field communication) from the peripheral device; and/or obtaining access to heavy equipment by communicating a third short range communication (e.g., a near field communication) from the peripheral device. The peripheral device may also: obtain article information for the article and/or identification information for the security via a fourth short range communication (e.g., a near field communication or a barcode communication); and forwarding the article information and/or identification information to the mobile POS device via a fifth short range communication (e.g., a Bluetooth communication). The peripheral device may further: obtain payment information for the article using an electronic card reader or a short range communication unit thereof (e.g., a near field communication unit or a barcode communication unit); and forward the payment information to the mobile POS device via a sixth short range communication (e.g., a Bluetooth communication). Retail item information and/or receipt information may be communicated from the peripheral device to a mobile communication device via a short range communication (e.g., a Bluetooth communication), as well.

BRIEF DESCRIPTION OF THE DRAWINGS

Embodiments will be described with reference to the following drawing figures, in which like numerals represent like items throughout the figures, and in which:

FIGS. 9A-9E collectively provide a flow diagram of an exemplary security tag detachment process that is useful for understanding the present invention.

DETAILED DESCRIPTION

Figure 1:
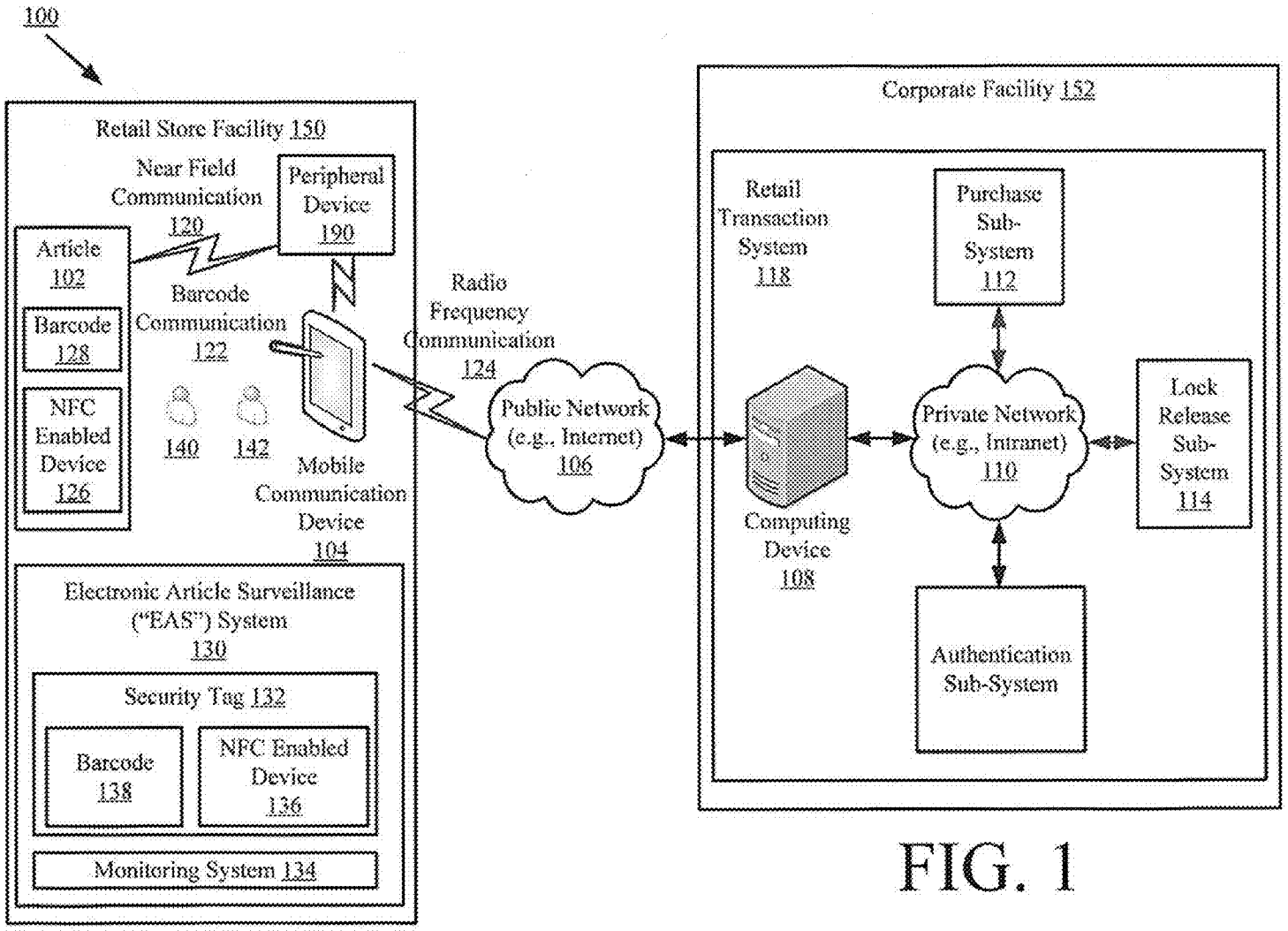
FIG. 1 is a schematic illustration of an exemplary system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects as illustrative. The scope of the invention is, therefore, indicated by the appended claims. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments will now be described with respect to FIGS. 1-10. Embodiments generally relate to systems and methods for operating a security tag of an EAS system. The methods involve physically coupling a peripheral device to a mobile POS device. For example, the peripheral device may include an insert space in which the mobile POS device can be at least partially disposed such that the peripheral device may wrap around at least a portion of the mobile POS device. Such a coupling configurations allows the mobile POS device and the peripheral device to be easily carried or worn by a user or vehicle. The methods also involves: installing an application and/or plug-in on a mobile POS device which is operative to facilitate the control of a peripheral device; receiving, by the mobile POS device, a request to detach the security tag from an article; and communicating a message from the mobile POS device to the peripheral device thereof via a first short range communication (e.g., a Bluetooth communication). The message is generally configured to cause the peripheral device to perform operations to facilitate a detachment of the security tag from the article. Thereafter, a signal is communicated from the peripheral device to the security tag for causing an actuation of a detachment mechanism of the security tag. The detachment mechanism can include, but is not limited to, an electro-mechanical detachment mechanism. The mechanical detachment portion of the electro-mechanical detachment mechanism may include, but is not limited to, a pin, a lanyard, and/or an adhesive.

Referring now to FIG. 1, there is provided a schematic illustration of an exemplary system 100 that is useful for understanding the present invention. System 100 is generally configured to allow a customer to purchase an article 102 using a Mobile Communication Device ("MCD") 104 and a Peripheral Device ("PD") 190 thereof. PD 190 is designed to be mechanically attached to the MCD 104. In some scenarios, PD 190 wraps around at least a portion of MCD 104. Communications between MCD 104 and PD 190 are achieved using a wireless Short Rage Communication ("SRC") technology, such as a Bluetooth technology. PD 190 also employs other wireless SRC technologies to facilitate the purchase of article 102. The other wireless SRC technologies can include, but are not limited to, Near Field Communication ("NFC") technology, InfRared ("IR") technology, Wireless Fidelity ("Wi-Fi") technology, Radio Frequency Identification ("RFID") technology, and/or ZigBee technology. PD 190 may also employ barcode technology, electronic card reader technology, and Wireless Sensor Network ("WSN") communications technology.

As shown in FIG. 1, system 100 comprises a retail store facility 150 including an EAS system 130. The EAS system 130 comprises a monitoring system 134 and at least one security tag 132. Although not shown in FIG. 1, the security tag 132 is attached to article 102, thereby protecting the article 102 from an unauthorized removal from the retail store facility 150. The monitoring system 134 establishes a surveillance zone (not shown) within which the presence of the security tag 132 can be detected. The surveillance zone is established at an access point (not shown) of the retail store facility 150. If the security tag 132 is carried into the surveillance zone, then an alarm is triggered to indicate a possible unauthorized removal of article 102 from the retail store facility 150.

During store hours, a customer 140 may desire to purchase the article 102. The customer 140 can purchase the article 102 without using a traditional fixed POS station (e.g., a checkout counter). Instead, the purchase transaction can be achieved using MCD 104 and PD 190, as mentioned above. MCD 104 (e.g., a tablet computer) can be in the possession of the customer 140 or store associate 142 at the time of the purchase transaction. An exemplary architecture of MCD 104 will be described below in relation to FIG. 3. An exemplary architecture of PD 190 will be described below in relation to FIG. 4. Still, it should be understood that MCD 104 has a retail transaction application installed thereon that is configured to facilitate the purchase of article 102 and the management/control of PD 190 operations for an attachment/detachment of the security tag 132 to/from article 102. The retail transaction application can be a pre-installed application, an add-on application or a plug-in application.

In order to initiate a purchase transaction, the retail transaction application is launched via a user-software interaction. The retail transaction application facilitates the exchange of data between the article 102, security tag 132, customer 140, store associate 142, and/or Retail Transaction System ("RTS") 118. For example, after the retail transaction application is launched, a user 140, 142 is prompted to start a retail transaction process for purchasing the article 102. The retail transaction process can be started simply by performing a user software interaction, such as depressing a key on a keypad of the MCD 104 or touching a button on a touch screen display of the MCD 104.

Subsequently, the user 140, 142 may manually input into the retail transaction application article information. Alternatively or additionally, the user 140, 142 places the MCD 104 in proximity of article 102. As a result of this placement, the PD 190 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the PD 190 via a short range communication, such as a barcode communication 122 or an NFC 120.

In the barcode scenario, article 102 has a barcode 128 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 102 and/or a purchase price of article 102. The barcode 128 is read by a barcode scanner/reader (not shown in FIG. 1) of the PD 190. Barcode scanners/readers are well known in the art. Any known or to be known barcode scanner/reader can be used herein without limitation.

In the NFC scenarios, article 102 may comprise an NFC enabled device 126. The NFC enabled device 126 can be separate from security tag 132 or comprise security tag 132. An NFC communication 120 occurs between the NFC enabled device 126 and the PD 190 over a relatively small distance (e.g., N centimeters or N inches, where N is an integer such as twelve). The NFC communication 120 may be established by touching components 126, 190 together or bringing them in close proximity such that an inductive coupling occurs between inductive circuits thereof. In some scenarios, the NFC operates at 13.56 MHz and at rates ranging from 106 kbit/s to 848 kbit/s. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

After the PD 190 obtains the article information, it forwards it to MCD 104 via a wireless SRC, such as a Bluetooth communication. Thereafter, payment information is input into the retail transaction application of MCD 104 by the user 140, 142. The payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer 140.

Upon obtaining the payment information, the MCD 104 automatically performs operations for establishing a retail transaction session with the RTS 118. The retail transaction session can involve: communicating the article information and payment information from MCD 104 to the RTS 118 via an RF communication 124 and public network 106 (e.g., the Internet); completing a purchase transaction by the RTS 118; and communicating a response message from the RTS 118 to MCD 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

Notably, the communications between MCD 104 and computing device 108 may be secure communications in which cryptography is employed. In such scenarios, a cryptographic key can also be communicated from MCD 104 to RTS 118, or vice versa. The cryptographic key can be a single use cryptographic key. Any type of cryptography can be employed herein without limitation.

The purchase transaction can be completed by the RTS 118 using the article information and payment information. In this regard, such information may be received by a computing device 108 of the RTS 118 and forwarded thereby to a subsystem of a private network 100 (e.g., an Intranet). For example, the article information and purchase information can also be forwarded to and processed by a purchase subsystem 112 to complete a purchase transaction. When the purchase transaction is completed, a message is generated and sent to the MCD 104 indicating whether the article 102 has been successfully or unsuccessfully purchased.

If the article 102 has been successfully purchased, then a security tag detaching process can be started automatically by the RTS 118 or by the MCD 104. Alternatively, the user 140, 142 can start the security tag detaching process by performing a user-software interaction using the MCD 104. In all three scenarios, the article information can be forwarded to and processed by a lock release sub-system 114 to retrieve a detachment key or a detachment code that is useful for detaching the security tag 132 from the article 102. The detachment key or code is then sent from the RTS 118 to the MCD 104 such that the MCD 104 can cause the PD 190 to perform tag detachment operations. The tag detachment operations of PD 190 are generally configured to cause the security tag 132 to actuate a detaching mechanism (not shown in FIG. 1). In this regard, the PD 190 generates a detach command and sends a wireless detach signal including the detach command to the security tag 132. The security tag 132 authenticates the detach command and activates the detaching mechanism. For example, the detach command causes a pin to be released, a lanyard to be released, and/or an adhesive to be heated such that the security tag can be detached from the article 102. The adhesive may be heated via current heating and/or via RF heating. Once the security tag 132 has been detached from article 102, the customer 140 can carry the article 102 through the surveillance zone without setting off the alarm.

Alternatively or additionally in all three security tag detaching scenarios, the MCD 104 may prompt the user 140, 142 to obtain a unique identifier (not shown in FIG. 1) for the security tag 132. The unique identifier can be obtained manually from user 140, 142 or via a wireless communication, such as a barcode communication or an NFC communication.

In the barcode scenario, security tag 132 has a barcode 138 attached to an exposed surface thereof. The barcode comprises a pattern or symbol that contains embedded data. The embedded data can include, but is not limited to, a unique identifier of the security tag 132 and/or a unique identifier of the article 102 being secured thereby. The barcode 138 is read by a barcode scanner/reader (not shown in FIG. 1) of the PD 190.

In the NFC scenario, security tag 132 may comprise an NFC enabled device 136. An NFC communication (not shown in FIG. 1) occurs between the NFC enabled device 136 and the PD 190 over a relatively small distance (e.g., N centimeters or N inches, where N is an integer such as twelve). The NFC communication may be established by touching components 136, 190 together or bringing them in close proximity such that an inductive coupling occurs between inductive circuits thereof. The NFC may be achieved using NFC transceivers configured to enable contactless communication at 13.56 MHz.

Once the unique identifier for the security tag 132 has been obtained, PD 190 communicates the same to MCD 104. In turn, MCD 104 communicates the unique identifier to the RTS 118 via network 106 (e.g., the Internet or a mobile phone network) and RF communication 124. At the RTS 118, the unique identifier is processed for various reasons. In this regard, the unique identifier may be received by computing device 108 and forwarded thereby to the lock release subsystem 114 to retrieve the detachment key or code that is useful for detaching the security tag 132 from article 102. The detachment key or code is then sent from the RTS 118 to the MCD 104. The MCD 104 forwards the detachment key or code to PD 190 such that the PD 190 can cause the security tag 132 to actuate a detaching mechanism (not shown in FIG. 1) in the same manner as described above.

In view of the forgoing, lock release sub-system 114 can comprise a data store in which detachment keys and/or detachment codes are stored in association with unique identifiers for a plurality of articles and/or security tags, respectively. Each detachment key can include, but is not limited to, at least one symbol selected for actuating a detaching mechanism of a respective security tag. In some scenarios, the detachment key can be a one-time-only use detachment key in which it enables the detachment of a security tag only once during a given period of time (e.g., N days, N weeks, N months, or N years, where N is an integer equal to or greater than 1). Each detachment code can include, but is not limited to, at least one symbol from which a detachment key can be derived or generated. The detachment key can be derived or generated by the MCD 104, the RTS 118, and/or PD 190. The detachment key and/or code can be stored in a secure manner within the MCD 104, PD 190 or the RTS 118, as will be discussed below. In the case that the key is generated by the MCD 104 or PD 190, the key generation operations are performed in a secure manner. For example, the algorithm for generating the key can be performed by a processor with a tamper-proof enclosure, such that if a person maliciously attempts to extract the algorithm from the processor the algorithm will be erased prior to any unauthorized access thereto.

Although FIG. 1 is shown as having two facilities (namely the retail store facility 150 and the corporate facility 152), the present invention is not limited in this regard. For example, the facilities 150, 152 can reside in the same or different building or geographic area. Alternatively or additionally, the facilities 150, 152 can be the same or different sub-parts of a larger facility.

Figure 2:
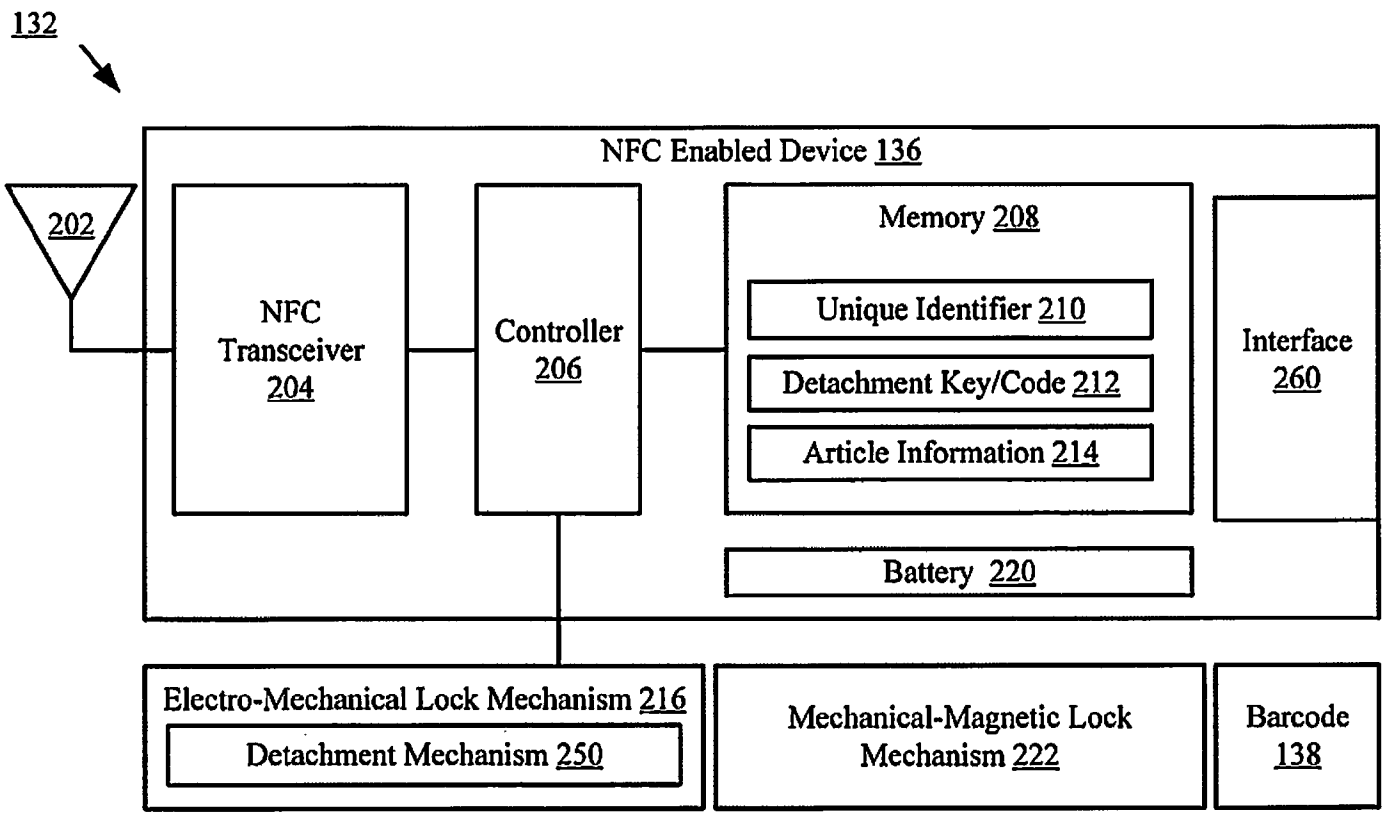
FIG. 2 is a block diagram of an exemplary architecture for a security tag shown in FIG. 1.

Referring now to FIG. 2, there is provided a schematic illustration of an exemplary architecture for security tag 132. Security tag 132 can include more or less components than that shown in FIG. 2. However, the components shown are sufficient to disclose an illustrative embodiment implementing the present invention. Some or all of the components of the security tag 132 can be implemented in hardware, software and/or a combination of hardware and software. The hardware includes, but is not limited to, one or more electronic circuits.

The hardware architecture of FIG. 2 represents an embodiment of a representative security tag 132 configured to facilitate the prevention of an unauthorized removal of an article (e.g., article 102 of FIG. 1) from a retail store facility (e.g., retail store facility 150 of FIG. 1). In this regard, the security tag 132 may have a barcode 138 affixed thereto for allowing data to be exchanged with an external device (e.g., PD 190 of FIG. 1) via barcode technology.

The security tag 132 also comprises an antenna 202 and an NFC enabled device 136 for allowing data to be exchanged with the external device via NFC technology. The antenna 202 is configured to receive NFC signals from the external device and transmit NFC signals generated by the NFC enabled device 136. The NFC enabled device 136 comprises an NFC transceiver 204. NFC transceivers are well known in the art, and therefore will not be described herein. However, it should be understood that the NFC transceiver 204 processes received NFC signals to extract information therein. This information can include, but is not limited to, a request for certain information (e.g., a unique identifier 210), and/or a message including information specifying a detachment key or code for detaching the security tag 132 from an article. The NFC transceiver 204 may pass the extracted information to the controller 206.

If the extracted information includes a request for certain information, then the controller 206 may perform operations to retrieve a unique identifier 210 and/or article information 214 from memory 208. The article information 214 can include a unique identifier of an article and/or a purchase price of the article. The retrieved information is then sent from the security tag 132 to a requesting external device (e.g., PD 190 of FIG. 1) via an NFC communication.

In contrast, if the extracted information includes information specifying a one-time-only use key and/or instructions for programming the security tag 132 to actuate a detachment mechanism 250 of an electro-mechanical lock mechanism 216, then the controller 206 may perform operations to simply actuate the detachment mechanism 250 using the one-time-only key. Alternatively or additionally, the controller 206 can: parse the information from a received message; retrieve a detachment key/code 212 from memory 208; and compare the parsed information to the detachment key/code to determine if a match exists therebetween. If a match exists, then the controller 206 generates and sends a command to the electro-mechanical lock mechanism 216 for actuating the detachment mechanism 250. An auditory or visual indication can be output by the security tag 132 when the detachment mechanism 250 is actuated. If a match does not exist, then the controller 206 may generate a response message indicating that detachment key/code specified in the extracted information does not match the detachment key/code 212 stored in memory 208. The response message may then be sent from the security tag 132 to a requesting external device (e.g., PD 190 of FIG. 1) via a wireless short-range communication or a wired communication via interface 260. A message may also be communicated to another external device or network node via interface 260.

In some scenarios, the connections between components 204, 206, 208, 216, 260 are unsecure connections or secure connections. The phrase "unsecure connection", as used herein, refers to a connection in which cryptography and/or tamper-proof measures are not employed. The phrase "secure connection", as used herein, refers to a connection in which cryptography and/or tamper-proof measures are employed. Such tamper-proof measures include enclosing the physical electrical link between two components in a tamper-proof enclosure.

Notably, the memory 208 may be a volatile memory and/or a non-volatile memory. For example, the memory 208 can include, but is not limited to, a Random Access Memory ("RAM"), a Dynamic Random Access Memory ("DRAM"), a Static Random Access Memory ("SRAM"), a Read-Only Memory ("ROM") and a flash memory. The memory 208 may also comprise unsecure memory and/or secure memory. The phrase "unsecure memory", as used herein, refers to memory configured to store data in a plain text form. The phrase "secure memory", as used herein, refers to memory configured to store data in an encrypted form and/or memory having or being disposed in a secure or tamper-proof enclosure.

The electro-mechanical lock mechanism 216 is operable to actuate the detachment mechanism 250. The detachment mechanism 250 can include a lock configured to move between a lock state and an unlock state. Such a lock can include, but is not limited to, a pin or a lanyard. In some scenarios, the detachment mechanism 250 may additionally or alternatively comprise an adhesive that can be heated via current heating or RF heating. The electro-mechanical lock mechanism 216 is shown as being indirectly coupled to NFC transceiver 204 via controller 206. The invention is not limited in this regard. The electro-mechanical lock mechanism 216 can additionally or alternatively be directly coupled to the NFC transceiver 204. One or more of the components 204, 206 can cause the lock of the detachment mechanism 250 to be transitioned between states in accordance with information received from an external device (e.g., PD 190 of FIG. 1). The components 204-208, 260 and a battery 220 may be collectively referred to herein as the NFC enabled device 136.

The NFC enabled device 136 can be incorporated into a device which also houses the electro-mechanical lock mechanism 216, or can be a separate device which is in direct or indirect communication with the electro-mechanical lock mechanism 216. The NFC enabled device 136 is coupled to a power source. The power source may include, but is not limited to, battery 220 or an A/C power connection (not shown). Alternatively or additionally, the NFC enabled device 136 is configured as a passive device which derives power from an RF signal inductively coupled thereto.

In some scenarios, a mechanical-magnetic lock mechanism 222 may also be provided with the security tag 132. Mechanical-magnetic lock mechanisms are well known in the art, and therefore will not be described in detail herein. Still, it should be understood that such lock mechanisms are detached using magnetic and mechanical tools.

Figure 3:
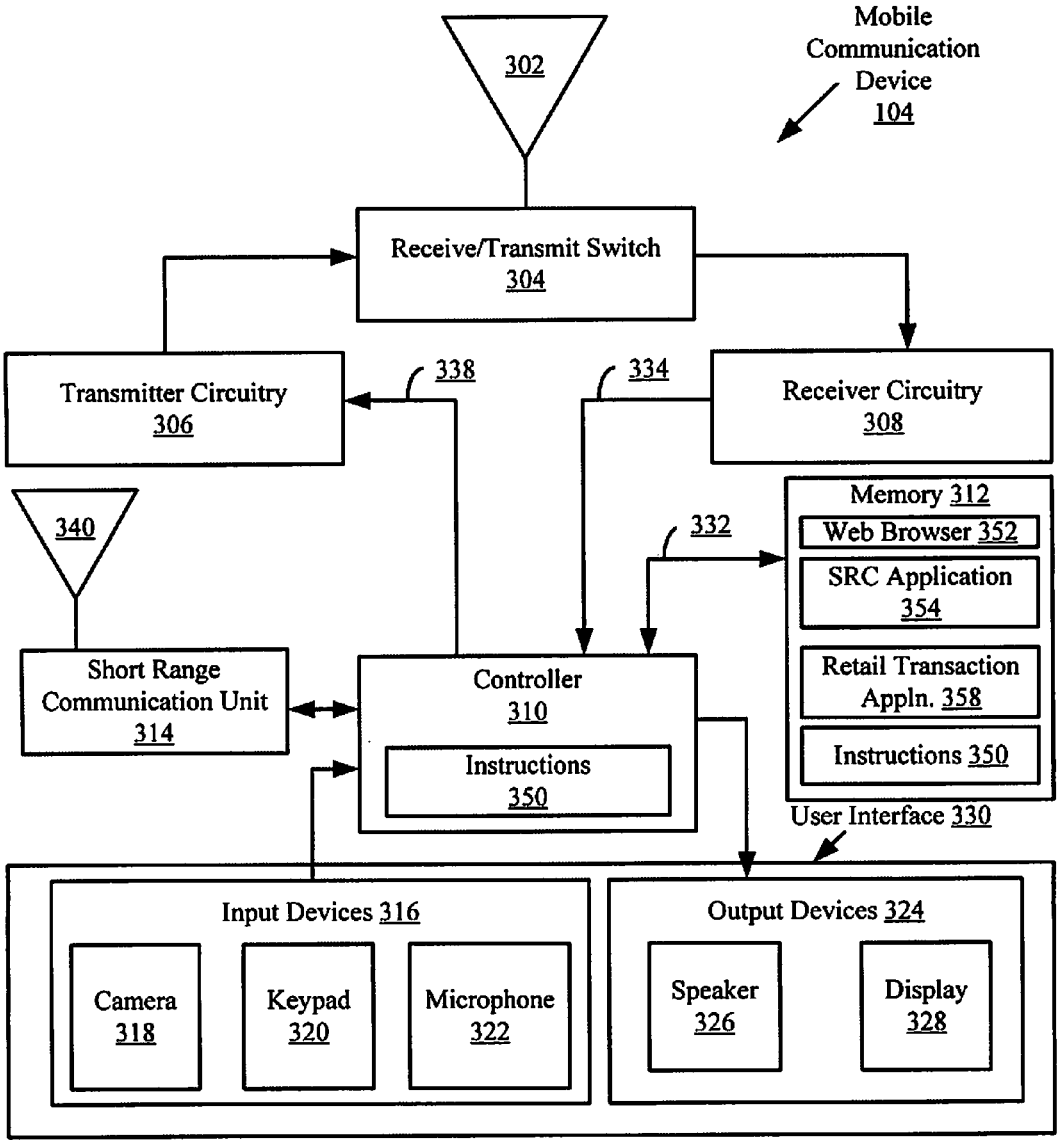
FIG. 3 is a block diagram of an exemplary architecture for a mobile communication device shown in FIG. 1.

Referring now to FIG. 3, there is provided a more detailed block diagram of an exemplary architecture for the MCD 104 of FIG. 1. In some scenarios, computing device 108 of FIG. 1 is the same as or similar to MCD 104. As such, the following discussion of MCD 104 is sufficient for understanding computing device 108 of FIG. 1.

MCD 104 can include, but is not limited to, a tablet computer, a notebook computer, a personal digital assistant, a cellular phone, or a mobile phone with smart device functionality (e.g., a Smartphone). MCD 104 may include more or less components than those shown in FIG. 3. However, the components shown are sufficient to disclose an illustrative embodiment implementing the present invention. Some or all of the components of the MCD 104 can be implemented in hardware, software and/or a combination of hardware and software. The hardware includes, but is not limited to, one or more electronic circuits.

The hardware architecture of FIG. 3 represents one embodiment of a representative MCD 104 configured to facilitate the data exchange (a) between an article (e.g., article 102 of FIG. 1) and an RTS (e.g., an RTS 118 of FIG. 1) via short-range communication technology and/or mobile technology and (b) between a security tag (e.g., security tag 132 of FIG. 1) and the RTS via short-range communication technology and/or mobile technology. In this regard, MCD 104 comprises an antenna 302 for receiving and transmitting RF signals. A receive/transmit ("Rx/Tx") switch 304 selectively couples the antenna 302 to the transmitter circuitry 306 and receiver circuitry 308 in a manner familiar to those skilled in the art. The receiver circuitry 308 demodulates and decodes the RF signals received from a network (e.g., the network 106 of FIG. 1). The receiver circuitry 308 is coupled to a controller (or microprocessor) 310 via an electrical connection 334. The receiver circuitry 308 provides the decoded signal information to the controller 310. The controller 310 uses the decoded RF signal information in accordance with the function(s) of the MCD 104.

The controller 310 also provides information to the transmitter circuitry 306 for encoding and modulating information into RF signals. Accordingly, the controller 310 is coupled to the transmitter circuitry 306 via an electrical connection 338. The transmitter circuitry 306 communicates the RF signals to the antenna 302 for transmission to an external device (e.g., a node of a network 106 of FIG. 1) via the Rx/Tx switch 304.

An antenna 340 may be coupled to an SRC communication unit 314 for receiving SRC signals. In some scenarios, SRC communication unit 314 implements Bluetooth technology. As such, SRC communication unit 314 may comprise a Bluetooth transceiver. Bluetooth transceivers are well known in the art, and therefore will not be described in detail herein. However, it should be understood that the Bluetooth transceiver processes the Bluetooth signals to extract information therefrom. The Bluetooth transceiver may process the Bluetooth signals in a manner defined by an SRC application 354 installed on the MCD 104. The SRC application 354 can include, but is not limited to, a Commercial Off The Shelf ("COTS") application. The Bluetooth transceiver provides the extracted information to the controller 310. As such, the SRC communication unit 314 is coupled to the controller 310 via an electrical connection 336. The controller 310 uses the extracted information in accordance with the function(s) of the MCD 104. For example, the extracted information can be used by the MCD 104 to generate a request for a detachment key or code associated with a particular security tag (e.g., security tag 132 of FIG. 1) from an RTS (e.g., an RTS 118 of FIG. 1). Thereafter, the MCD 104 sends the request to the RTS via transmit circuitry 306 and antenna 302.

The controller 310 may store received and extracted information in memory 312 of the MCD 104. Accordingly, the memory 312 is connected to and accessible by the controller 310 through electrical connection 332. The memory 312 may be a volatile memory and/or a non-volatile memory. For example, the memory 312 can include, but is not limited, a RAM, a DRAM, an SRAM, a ROM and a flash memory. The memory 312 may also comprise unsecure memory and/or secure memory. The memory 212 can be used to store various other types of information therein, such as authentication information, cryptographic information, location information and various service-related information.

As shown in FIG. 3, one or more sets of instructions 350 are stored in memory 312. The instructions 350 may include customizable instructions and non-customizable instructions. The instructions 350 can also reside, completely or at least partially, within the controller 310 during execution thereof by MCD 104. In this regard, the memory 312 and the controller 310 can constitute machine-readable media. The term "machine-readable media", as used here, refers to a single medium or multiple media that stores one or more sets of instructions 350. The term "machine-readable media", as used here, also refers to any medium that is capable of storing, encoding or carrying the set of instructions 350 for execution by the MCD 104 and that causes the MCD 104 to perform one or more of the methodologies of the present disclosure.

The controller 310 is also connected to a user interface 330. The user interface 330 comprises input devices 316, output devices 324 and software routines (not shown in FIG. 3) configured to allow a user to interact with and control software applications (e.g., application software 352-356 and other software applications) installed on the MCD 104. Such input and output devices may include, but are not limited to, a display 328, a speaker 326, a keypad 320, a directional pad (not shown in FIG. 3), a directional knob (not shown in FIG. 3), a microphone 322 and a camera 318. The display 328 may be designed to accept touch screen inputs. As such, user interface 330 can facilitate a user-software interaction for launching applications (e.g., application software 352-356) installed on MCD 104. The user interface 330 can facilitate a user-software interactive session for writing data to and reading data from memory 312.

The display 328, keypad 320, directional pad (not shown in FIG. 3) and directional knob (not shown in FIG. 3) can collectively provide a user with a means to initiate one or more software applications or functions of the MCD 104. The application software 354-358 can facilitate the data exchange (a) between an article (e.g., article 102 of FIG. 1) and an RTS (e.g., an RTS 118 of FIG. 1) and (b) between a security tag (e.g., security tag 132 of FIG. 1) and the RTS. In this regard, the application software 354-358 performs one or more of the following: verify an identity of a user of the MCD 104 via an authentication process; present information to the user indicating that her/his identity has been or has not been verified; and/or determining if the user is within a particular area of a retail store in which s/he is authorized to use retail-related functions of the MCD 104. Such a determination can be achieved using a "keep alive" or "heart beat" signal which is received by the MCD 104 from the EAS system. The "keep alive" or "heart beat" signal can have a certain frequency, voltage, amplitude and/or information, which the MCD 104 may detect and compare with pre-stored values to determine if a match exists therebetween. If a match does or does not exist, then the MCD 104 will perform one or more predefined operations for enabling or disabling one or more functions thereof.

In some scenarios, the "keep alive" or "heart beat" signal can cause one or more operations of the MCD 104 to be enabled or disabled such that the user of the MCD 104 is allowed access to and use of retail-related functions in a controlled manner. For example, a store associate may be authorized to complete a purchase transaction of articles in an electronic department of a retail store, but not of items in a pharmacy of the retail store. Accordingly, retail-purchase transaction operations of the MCD 104 are enabled when the store associated is in the electronic department and disabled when the store associate is in the pharmacy. The "keep alive" or "heart beat" signal can also cause one or more operations of the MCD 104 to be enabled or disabled such that the MCD 104 will not operate if taken out of the store so as to prevent theft thereof.

The application software 354-358 can also perform one or more of the following: generate a list of tasks that a particular store associate is to perform; display the list to the store associate using the MCD 104; and/or dynamically update the list based on information received from the store associate, and EAS system, a security tag, and/or an RTS. For example, the list may include a plurality of asks: handle a customer in isle 7 of the grocery store; stock shelves in isle 9 of the grocery store; and/or lock/unlock a cabinet or a piece of equipment.

The application software 354-358 can further perform one or more of the following: present a Graphical User Interface ("GUI") to the user for enabling the user to initiate a retail transaction process for purchasing one or more articles (e.g., article 102 of FIG. 1); and/or present a GUI to the user for enabling the user to initiate a detachment process for detaching a security tag (e.g., security tag 132 of FIG. 1) from an article (e.g., article 102 of FIG. 1).

The retail transaction process can generally involve: prompting a user of the MCD 104 to manually input article information or prompting the user of the MCD 104 to place MCD with the PD 190 attached thereto in proximity to the article; obtaining the article information manually from the user or automatically from the article via short range communication (e.g., barcode communication or NFC communication) using the PD 190; prompting the user for payment information; obtaining payment information manually from the user of the MCD or automatically from a payment card via an electronic card reader or a barcode reader of PD 190; and establishing a retail transaction session with an RTS (e.g., RTS 118 of FIG. 1).

The retail transaction session generally involves: communicating the article information and payment information to the RTS via public network connection; receiving a response message from the RTS indicating that the article has been successfully or unsuccessfully purchased; and automatically starting the detachment process or prompting the user to start the detachment process if the article has been successfully purchased.

The detachment process can generally involve: obtaining a unique identifier (e.g., unique identifier 210 of FIG. 2) from the article (e.g., article 102 of FIG. 1) and/or the security tag (e.g., security tag 132 of FIG. 1) via PD 190; forwarding the unique identifier(s) to the RTS; receiving a message from the RTS that includes information specifying a detachment key or a detachment code associated with the unique identifier; optionally deriving the detachment key from the detachment code; optionally generating instructions for programming the security tag to unlock an electronic lock mechanism using the detachment key on a one-time basis; commanding PD 190 to forward the detachment key and/or instructions to the security tag via an SRC communication. In some scenarios, the MCD simply forwards the information received from the RTS to the PD 190 without modification. In other scenarios, the MCD modifies the information prior to communication to the PD 190. Such modifications can be performed by a processor with a tamper-proof enclosure such that if a person tries to maliciously obtain access to any algorithm used for such modification purposes, the algorithm(s) will be erased prior to any access thereto. This configuration may be advantageous when cryptography is not employed for communications between the MCD and the RTS. Still, this configuration may be employed even when such cryptography is used.

Figure 4:
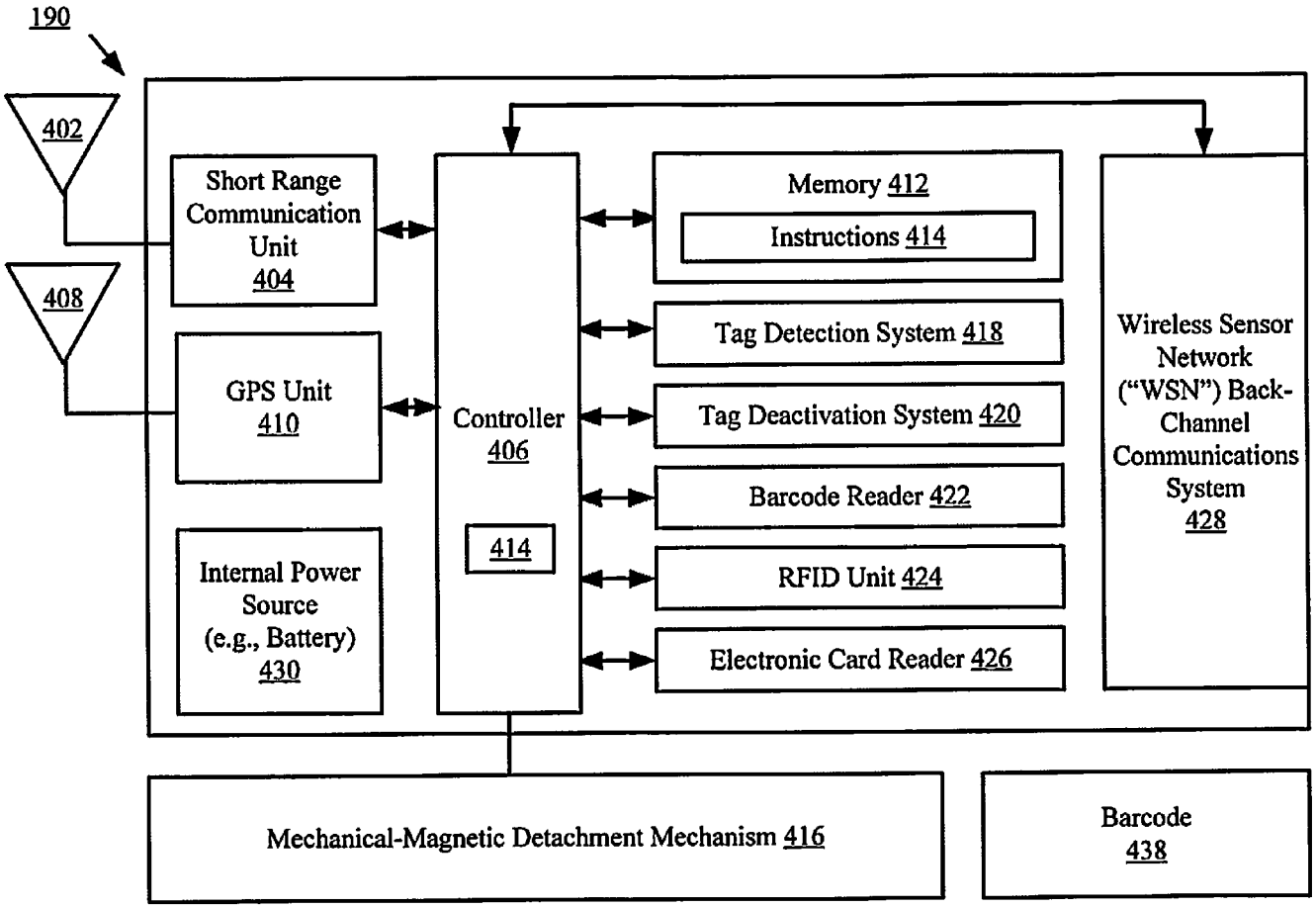
FIG. 4 is a block diagram of an exemplary architecture for a peripheral device shown in FIG. 1.

Referring now to FIG. 4, there is provided a block diagram of an exemplary architecture for the PD 190 of FIG. 1. PD 190 comprises an internal power source 430 for supplying power to certain components 404, 406, 410, 412, 418-428 thereof. Power source 430 can comprise, but is not limited to, a rechargeable battery, a recharging connection port, isolation filters (e.g., inductors and ferrite based components), a voltage regulator circuit, and a power plane (e.g., a circuit board layer dedicated to power). PD 190 may include more or less components than those shown in FIG. 4. For example, PD 190 may further include a UHF radio unit. However, the components shown are sufficient to disclose an illustrative embodiment implementing the present invention. Some or all of the components of the PD 190 can be implemented in hardware, software and/or a combination of hardware and software. The hardware includes, but is not limited to, one or more electronic circuits.

Figure 6:
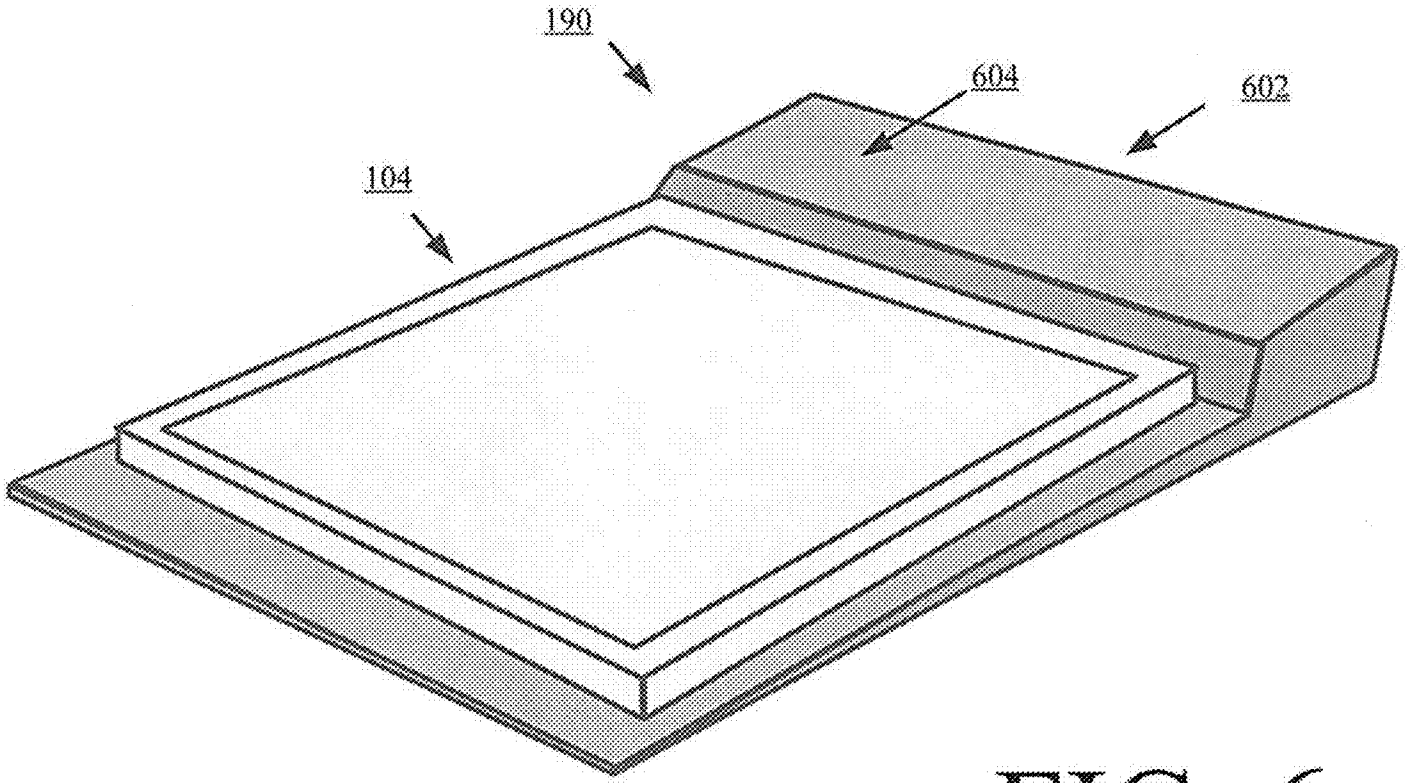
FIG. 6 is a perspective view of a mobile communication device with a peripheral device that is useful for understanding the present invention.

Notably, PD 190 is a peripheral device of MCD 104. In some scenarios, PD 190 is designed to wrap around at least a portion of MCD 104. A schematic illustration of such a PD 190 design is provided in FIG. 6. As shown in FIG. 6, the PD 190 comprises a cover or a holder for a tablet computer 104. Embodiments of the present invention are not limited to the exemplary PD architecture shown in FIG. 6. PD 190 may have other architectures for applications in which different types of MCDs are employed (e.g., a Smartphone). In such applications, PD may still be designed to cover at least a portion of MCD such that PD provides a relatively small mobile POS device which is easy to carry by or on a person or vehicle. In all such scenarios, PD 190 is also configured to protect MCD from damage during use thereof.

The PD 190 is also configured to provide at least some of the critical peripheral functions required by a wide variety of mobile retail applications which are not provided by the MCD 104. As such, PD 190 comprises a controller 406 and an SRC unit 404 for coordinating its activities with those of MCD 104. In some scenarios, SRC unit 404 includes, but is not limited to, a Bluetooth transceiver and/or an NFC transceiver. Notably, the PD 190 acts as a slave device to the master MCD 104. Thus, operations of PD 190 are managed and/or controlled by MCD 104. The manner in which operations of PD 190 are managed and/or controlled by MCD 104 will become more evident as the discussion progresses.

The critical peripheral functions can include, but are not limited to, EAS tag detection functions, EAS tag deactivation/detachment functions, RFID tag read functions, device location determining/tracking/reporting functions, and/or SRC communication functions with EAS security tags, mobile POS equipment, and customer handled devices. In this regard, PD 190 comprises antennas 402, 408, the SRC unit 404, a GPS unit 410, the controller 406, memory 412, a tag detection system 418, a tag deactivation system 420, a barcode reader 422, an RFID unit 424, an electronic card reader 426, and a WSN back-channel communication system 428. PD 190 may also comprise a mechanical-magnetic detachment mechanism 416 and a barcode 438. The listed components 404-412 and 416-428 are housed together in a light weight protective shell (e.g., shell 602 of FIG. 6). The protective shell can be made from a hard rubber or plastic which can protect the listed components 404-412 and 416-428 and the MCD 104 from damage as a result from external factors. The protective shell may also be designed to improve the ergonomics of MCD 104 by making it easier to hold in a user's hands, attach to a vehicle, or wear on a user's body when not in use.

Also, the components can be arranged within the protective shell in any manner that is suitable for a particular application. For example, tag detection and/or deactivation components can be placed within a specific portion (e.g., portion 604 of FIG. 6) the protective shell which is not covered by the MCD coupled to the PD. The antennas may be placed in the protective shell so as to reside below the MCD coupled to the PD.

Each component 404-412 and 416-428 provides one or more capabilities required by various retail applications related to mobile POS operations. For example, during a mobile POS transaction, the SRC unit 404 is used to gain access to a locked display case or other secure area of a retail store in which a retail item(s) is(are) disposed. In some scenarios, heavy equipment may be needed to acquire the retail item(s). Access to such heavy equipment can be obtained using the SRC unit 404. The SRC unit 404 and/or barcode reader 422 are then used to obtain article information needed for a purchase transaction. The article information can be obtained directly from the retail item(s) or from a tag/label disposed adjacent to an edge of a shelf on which the retail item(s) is(are) disposed. Similarly, the electronic card reader 426 is used to obtain payment information from the customer. Upon a successful purchase of the retail item(s), the tag deactivation system 420 is used to deactivate any electromechanical lock mechanisms (e.g., lock mechanism 216 of FIG. 2) present on the retail item(s). Also, the RFID unit 424 may be used to deactivate RFID tags present with the retail item(s) (e.g., write to the sold item bit in memory). A mechanical-magnetic detachment mechanism 416 may be used to detach any mechanical-magnetic lock mechanisms (e.g., lock mechanism 222 of FIG. 2) coupled to the retail item(s). Subsequently, retail item information and/or receipt information is communicated to the customer's own mobile device via the SRC unit 404. In some scenarios, the RFID unit 424 may also be used to find RFID-tagged retail item(s) on a shelf or in a display rack (e.g., a garment rack), write receipt data to an RFID tag embedded in a transaction receipt paper or card, and/or conduct inventory cycle count.

The WSN back-channel communications system 428 allows PD to function as a node in a wireless network. In this regard, system 428 may be used as the main data link between PD 190 and an RTS (e.g., RTS 118). System 428 may also be used to physically locate the MCD within the retail store, monitor activities of the MCD, upgrade software of PD and/or MCD, and/or physically lock PD if PD is removed from the retail store without authorization. System 428 may further be used to directly transfer transaction and event data to other devices in the retail store (e.g., smart EAS pedestals or EAS pedestals synchronization systems) which may be untethered to the retail store's main network (e.g., intranet 110 of FIG. 1).

In some scenarios, system 428 comprises a WSN transceiver, an antenna, and matching circuitry appropriate for frequency bands being used in WSN communication. System 428 may also comprise a controller, separate from controller 406, for facilitating the control of the operations of the WSN transceiver of system 428. This separate controller may act as a slave to controller 406. System 428 may further comprise power management circuitry which draws power from an internal power source separate from internal power source 430.

Using system 428, PD 190 can communicate its status and activity over the wireless sensor network, receive software updates, and perform management tasks (e.g., location tasks). By using the SRC unit 404 and system 428, the MCD/PD has a way to communicate with other applications running on remote servers or network nodes of a public network (e.g., public network 106 of FIG. 1), assuming system 428 is connected directly or via routers to those remote servers or network nodes. Also, SRC communications and/or WSN communications may be used by the MCD/PD for accessing resources of an RTS system (e.g., RTS system 118 of FIG. 1) or public network if alternative communication channels fail or are too busy. In some scenarios, system 428 may employ any number of standard communications channels, frequencies and/or protocols. For example, system 428 employs ISM bands (e.g., 433 MHz, 902-928 MHz, and 2.4 GHzs). Thus, an important advantage of including system 428 as part of PD 190 is to improve the overall connectivity robustness and network connection options of the MCD.

As evident from the above discussion, PD 190 comprises at least four separate systems 404, 420, 424, 428 for wireless data collection and security tag interaction. In some scenarios, these systems 404, 420, 424, 428 use different communication bands, frequencies, and/or protocols. For example, tag detection system 420 is configured to deactivate AcoustoMagnetic ("AM") security tags with a pulse of high energy at around 58 KHz. SRC unit 404 may comprise an NFC transceiver operating at around 13.56 MHz. RFID unit 424 and WSN back-channel communication system 428 operate in the Ultra High Frequency ("UHF") Industrial, Scientific and Medical ("ISM") bands (i.e., 850-950 MHz). The components 424, 428 may be combined into a single unit using a UHF radio employing two different software functions to implement the two RFID and WSN protocols.

As noted above, PD 190 comprises an RFID unit 424. In some scenarios, RFID unit 424 comprises an active-RFID or Real-Time Location System ("RTLS") tag which is used in conjunction with external readers and/or transceivers to locate the PD 190 and determine its status. The active-RFID or RTLS tag is integrated into the PD 190 and communicates with controller 406. The active-RFID or RTLS tag also allows PD 190 to communicate its status and/or activity over a network to which a reader or transceiver is attached. The RFID unit 424 also comprises hardware and/or software configured to receive software updates, perform management tasks (e.g., location determining and/or reporting tasks), read RFID tags, and/or write to RFID tags.

The operations of RFID unit 424 can be controlled by the MCD to which PD 190 is attached. In this regard, the MCD comprises software (e.g., software 358 of FIG. 3) configured to serve as an interface to RFID unit 424. The RFID functions of the MCD/PD combination can be used in a variety of applications. For example, the RFID functions may be used in stock-keeping process in which a number of RFID-tagged retail items present within a retail store are counted. In this case, the MCD communicates command to the PD via SRCs (e.g., Bluetooth communications) for initiating such RFID stock-keeping activities.

Clearly, components 406, 424, 428 together form a link set which can be used to make RFID tags visible to external applications running in the WSN or devices in any network connection to the WSN. This activity may be managed and/or triggered by a software application running on controller 406 of PD 190 or by a software application running on the MCD via an SRC connection (e.g., a Bluetooth connection).

In some scenarios, retail NFC tags may be placed on retail items or in the retail environment (e.g., on the edges of retail shelves or on placards in prominent locations inside a retail store). The SRC unit 404 may be used to obtain information from these retail NFC tags via NFC communications. Such information can include, but is not limited to, instructions for use, promotional information, product warning information, product ingredient information, product price information, and/or product availability information. An NFC communication occurs between the SRC unit 404 and the retail NFC tag over a relatively small distance (e.g., N centimeters or N inches, where N is an integer such as twelve). The NFC communication may be established by touching the SRC unit 404 and retail NFC tag 190 together or bringing them in close proximity such that an inductive coupling occurs between inductive circuits thereof. The information obtained via these NFC communications may then be forwarded from the SRC unit 404 to controller 406. In turn, the controller 406 forwards the information to the MCD via an SRC (e.g., a Bluetooth communication). At the MCD, the information is processed to determine what action is to be taken. In the case of a look-up, a certain type of information for the retail item in question may be retrieved from an RTS (e.g., RTS 118 of FIG. 1). The retrieved information may then be displayed to a user of the MCD/PD.

NFC communications may also be used to transfer itemized or aggregated sales data, employee activity data, or other operations data from an MCD to which the PD 190 is coupled to another MCD of the retail store. Such a data transfer may be facilitated by the respective WSN back-channel communications systems 428 and/or the SRC units 404 of the PDs of the two MCDs. Prior to this WSN data transfer, identification and/or authentication operations may be performed as an MCD-to-MCD data transfer security protocol.

One or more sets of instructions 414 are stored in memory 412. The instructions 414 may include customizable instructions and non-customizable instructions. The instructions 414 can also reside, completely or at least partially, within the controller 406 during execution thereof by PD 190. In this regard, the memory 412 and the controller 406 can constitute machine-readable media. The term "machine-readable media", as used here, refers to a single medium or multiple media that stores one or more sets of instructions 414. The term "machine-readable media", as used here, also refers to any medium that is capable of storing, encoding or carrying the set of instructions 414 for execution by the PD 190 and that causes the PD 190 to perform one or more of the methodologies of the present disclosure.

Notably, in some scenarios, the GPS unit 410 can be used to facilitate the enablement and disablement of one or more operations of the PD 190 and/or MCD 104. For example, the location of the PD 190 and/or MCD 104 can be determined using the GPS unit 410. Information specifying the location of the PD 190 and/or MCD 104 can be sent to the EAS system 130 and/or RTS 118 for processing thereat. Based on the location information, the system 118, 130 can generate and communicate a command to the PD 190 and/or MCD 104 to enable or disable operations thereof. Such a configuration may be employed to ensure that a user of the PD 190 and/or MCD 104 is able to access and use certain functions thereof only within a specified area of a retail store. Also, such a configuration can prevent theft of the PD 190 and/or MCD 104 since one or more operations thereof can be disabled when the equipment leaves the premises of the retail store.

Figure 5:
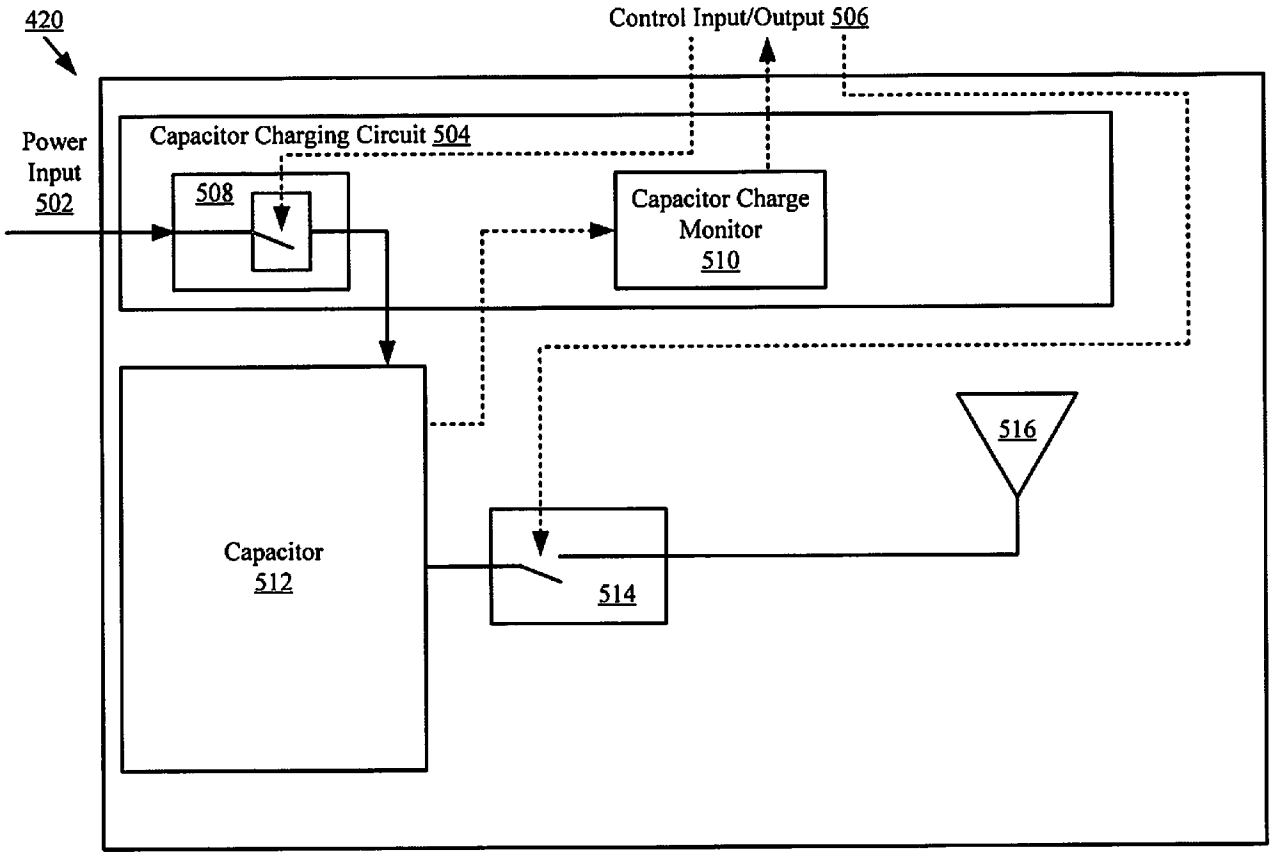
FIG. 5 is a block diagram of an exemplary architecture for a tag deactivation system shown in FIG. 4.

Referring now to FIG. 5, there is provided a block diagram of an exemplary architecture for a tag deactivation system 420 shown in FIG. 4. System 420 comprises a capacitor charging circuit 504, a capacitor 512, a discharging switch 514 and a deactivation antenna 516. The capacitor charging circuit 504 includes a charging switch 508 and a capacitor charge monitor 510. During operation, a control signal is received by system 420 from controller 406 of FIG. 4. The control signal includes information for closing charging switch 508. When charging switch 508 is closed, power is supplied from power input 502 to charge capacitor 512. The charge on capacitor 512 is monitored by capacitor charge monitor 510. Monitor 510 communicates capacitor charge information to the controller 406 of FIG. 4 such that controller 406 can additionally or alternatively monitor the charge on capacitor 512. Based on the capacitor charge information, a determination is made as to whether the charging switch 508 should be opened or closed (i.e., to charge or not charge the capacitor 512). A determination is also made as to whether a discharging switch 514 should be opened or closed (i.e., to discharge or not discharge capacitor 512). If it is determined that capacitor 512 should be discharged, then discharging switch 514 is closed such that capacitor 512 discharges through antenna 516. As a result of the capacitor discharge, energy is pulsed at a desired frequency from the antenna 516.

Figure 7:
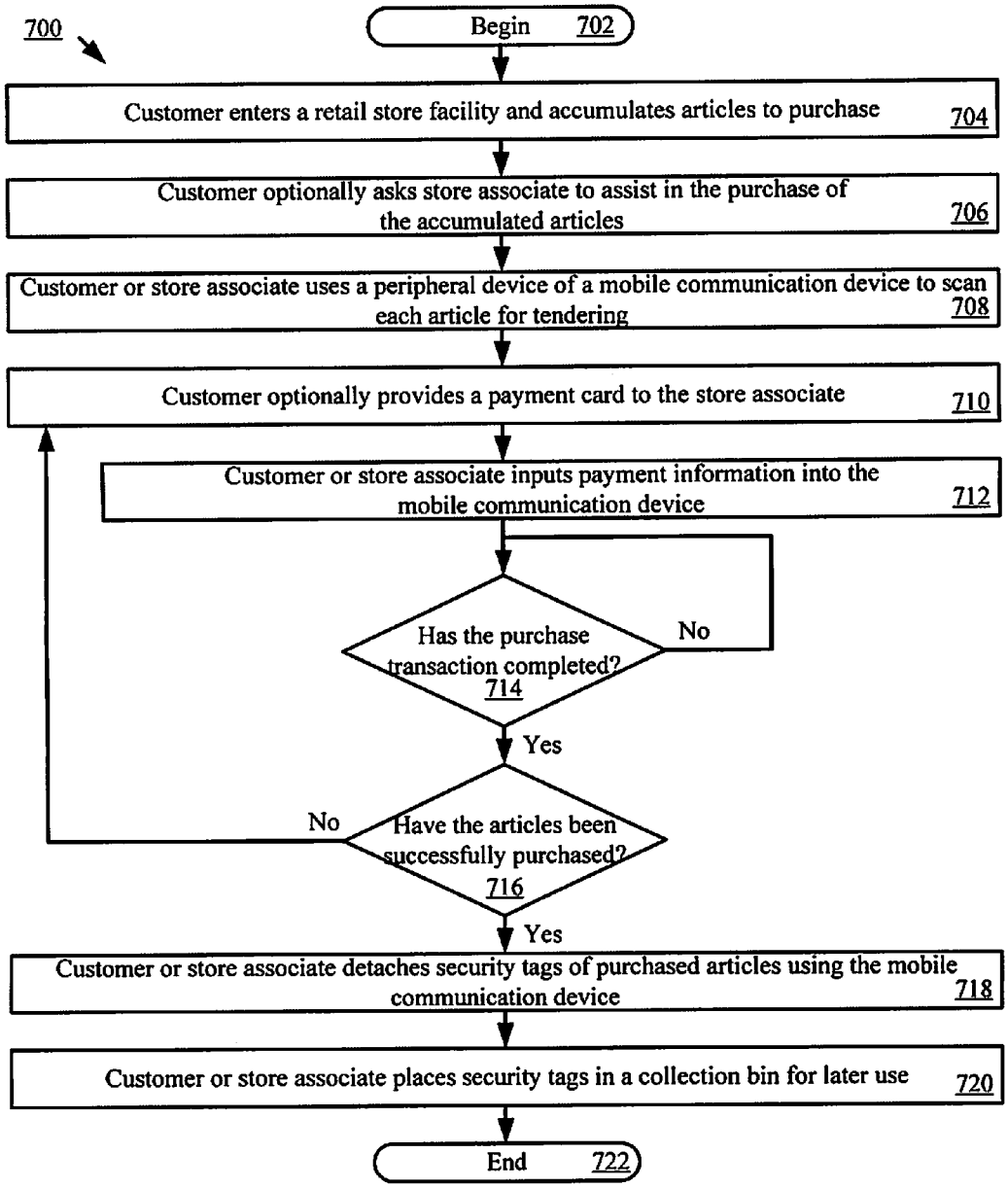
FIG. 7 is a flow diagram of an exemplary method for purchasing an article from a retail store facility that is useful for understanding the present invention.

Referring now to FIG. 7, there is provided a flow diagram of an exemplary method 700 for purchasing an article (e.g., article 102 of FIG. 1) from a retail store facility (e.g., retail store facility 150 of FIG. 1) that is useful for understanding the present invention. Although not shown in FIG. 7, it should be understood that user authentication operations and/or function enablement operations may be performed prior to step 702. Such operations are described above. For example, a user of the MCD may be authenticated, and therefore one or more retail-transaction operations of the MCD may be enabled based on the clearance level of the user and/or the location to the MCD within a retail store facility. The location of the MCD can be determined using GPS information. In some scenarios, a "heart beat" signal may be used to enable the retail-transaction operation(s) of the MCD and/or PD. The "heart beat" signal may be communicated directly to the MCD or indirectly to the MCD via the PD.

After step 702, method 700 continues with step 704 where a customer (e.g., customer 140 of FIG. 1) enters the retail store facility and accumulates one or more articles to purchase. In some scenarios, the customer may then ask a store associate (e.g., store associate 142 of FIG. 1) to assist in the purchase of the accumulated articles, as shown by optional step 706. Optional step 706 may be performed when the customer 140 does not have an MCD (e.g., MCD 104 of FIG. 1) with a retail transaction application installed thereon and/or a PD (e.g., peripheral device 190 of FIG. 1) coupled thereto. If the customer is in possession of such an MCD, then the customer would not need the assistance from a store associate for completing a purchase transaction and/or detaching security tags from the articles.

In a next step 708, the customer or store associate uses the PD of the MCD to scan each article for tendering. The scanning can be achieved using a barcode scanner (e.g., barcode reader 422 of FIG. 4), an RFID scanner (e.g., RFID unit 424 of FIG. 4), an NFC tag scanner (e.g., SRC unit 404 of FIG. 4), or any other short-range communication means. Once the articles have been scanned, payment information is input into the retail transaction application of the MCD, as shown by steps 710-712. The payment information can be input by the person in possession of the MCD (i.e., the customer or the store associate). The payment information can include, but is not limited to, a customer loyalty code, payment card information, and/or payment account information. The payment information can be input manually using an input device (e.g., input devices 316-322 of FIG. 3) of MCD, via an electronic card reader (e.g., a magnetic strip card reader) of PD (e.g., electronic card reader 426 of FIG. 4), and/or via a barcode reader of PD (e.g., barcode reader 422 of FIG. 4). In the card/barcode scenarios, the customer may provide a payment card to the store associate, as shown by optional step 710.

After the payment information has been input into the retail transaction application, a decision step 714 is performed to determine if a purchase transaction has been completed. This determination is made by the MCD based on information received from an RTS, as described above. An exemplary purchase transaction process will be described below in relation to FIG. 8. If the purchase transaction is not completed [714:NO], then method 700 returns to step 714. If the purchase transaction is completed [714:YES], then a decision step 716 is performed. In step 716, it is determined whether the articles have been successfully purchased. If the articles have not been successfully purchased [716:NO], then method 700 returns to step 710. In contrast, if the articles have been successfully purchased [716:YES], then steps 718-722 are performed.

Step 718 involves detaching the security tags (e.g., security tag 132 of FIG. 1) from the articles. The security tags are detached by the customer or store associate using the MCD and/or PD. An exemplary detachment process will be described below in relation to FIGS. 9A-9E. The detached security tag can then be placed in a collection bin for later use, as shown by step 720. Subsequently, step 722 is performed where method 700 ends.

Figure 8:
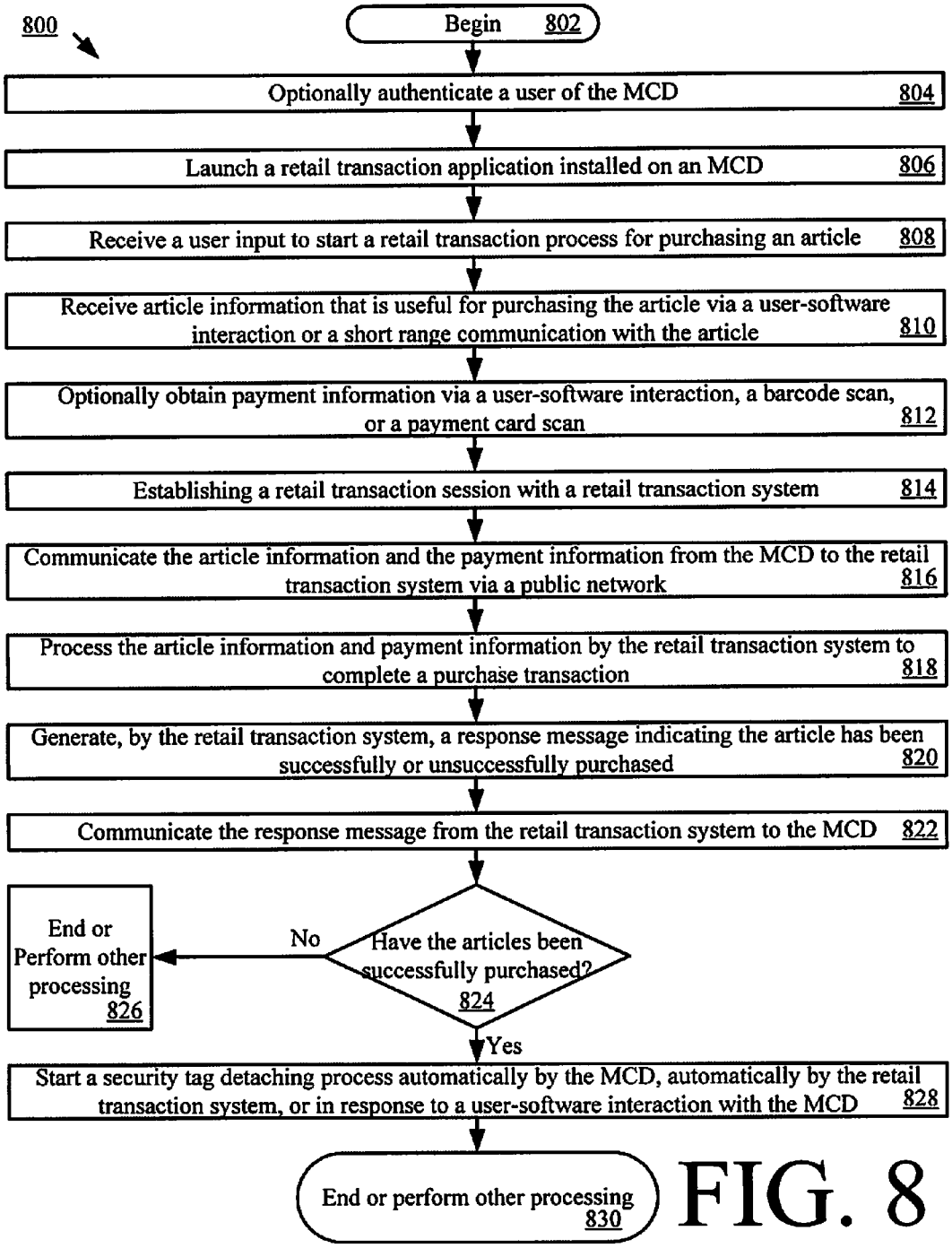
FIG. 8 is a flow diagram of an exemplary purchase transaction process facilitated by a mobile communication device (e.g., a table or Smartphone).

Referring now to FIG. 8, there is provided an exemplary purchase transaction process 800 facilitated by an MCD (e.g., MCD 104 of FIG. 1) with a PD (e.g., PD 190 of FIG. 1) communicatively coupled thereto. Process 800 begins with step 802 and continues with optional step 804. In optional step 804, the authentication information (e.g., a user name, a password, or biometric information) is obtained from a user thereof. The authentication information is used by the MCD and/or PD for authenticating the user (e.g., customer 140 of FIG. 1 or store associate 142 of FIG. 1).

In some scenarios, the authentication information is obtained using input devices of MCD (e.g., input devices 316 of FIG. 3) and/or input devices of PD (e.g., input devices 404, 422, 424 and/or 426 of FIG. 4). For example, an SRC unit (e.g., SRC unit 404 of FIG. 4) of PD is used for facilitating the security of and access to MCD. A general problem associated with the use of retail operations oriented MCDs is the physical security thereof. That is, the retailer must make sure that unauthorized employees and customers cannot use the MCD for unauthorized activities, such as a malicious deactivation of a security tag and/or a malicious access to the retail store's general network (e.g., private network 110 of FIG. 1). The SRC unit of PD can be used in conjunction with an SRC security tag or label on the authorized customer 140 or store associate 142 (e.g., integrated with an employee's name badge or included with a key chain) to secure MCD.

In these and/or other scenarios, a retail transaction application (e.g., application 358 of FIG. 3) may be in a secure sleep mode for power saving purposes. In the secure sleep mode, a display screen (e.g., display 328 of FIG. 3) is darkened and all unnecessary processor functions are stopped. Also, an Input/Output ("IO") interrupt service of MCD monitors an SRC interface (e.g., SRC unit 314 of FIG. 3) for SRCs received from PD. At this time, PD may also be in a sleep mode in which only certain components thereof are active, such as an SRC unit (e.g., SRC unit 404 of FIG. 4), an RFID reader (e.g., RFID unit 424 of FIG. 4) or a barcode reader (e.g., barcode reader 422 of FIG. 4). When an authorized store associate or customer picks up the MCD, the PD is brought in close proximity to a security item thereof (e.g., an NFC-enabled key chain fob or name badge). Consequently, the PD obtains a number or code from the security item via an SRC, barcode scan or RFID read. This activity causes PD to exit its sleep mode. The number/code can then be analyzed by the PD or the MCD to determine if the current user is authorized to perform retail transactions therewith.

If the number/code is to be analyzed by PD, then PD compares the received number/code with authorized codes stored in an internal memory (e.g., memory 412 of FIG. 4) thereof or in an external memory (e.g., a memory of RTS 118 of FIG. 1) thereof. In this regard, PD may query the external memory for authorized codes via a WSN back-channel communications system (e.g., system 428 of FIG. 4) thereof. Based on the results of said comparison, PD optionally communicates a message via an SRC (e.g., a Bluetooth communication) to MCD. The message includes information specifying whether or not the current use is authorized to perform retail transactions therewith. MCD may then optionally exit its sleep mode in response to the reception of said message. For example, MCD may exit its sleep mode when it receives a message indicating that the current user is an authorized user thereof.

In contrast, if the number/code is to be analyzed by MCD, then the number/code is forwarded to the MCD from the PD via the SRC unit. In response to the reception of the number/code, the MCD exits its sleep mode using an IO service routine thereof. Thereafter, MCD compares the received number/code with authorized codes stored in an internal memory (e.g., memory 312 of FIG. 3) thereof or in an external memory (e.g., a memory of RTS 118 of FIG. 1) thereof. In this regard, MCD may query the external memory for authorized codes via the WSN back-channel communications system (e.g., system 428 of FIG. 4) of PD and/or via a secure communication over a public network (e.g., public network 106 of FIG. 1).

Referring again to FIG. 8, method 800 continues with step 808 after the user has been authenticated. Step 806 is performed where the MCD launches a retail transaction application (e.g., retail transaction application 358 of FIG. 3) configured to facilitate the purchase of one or more articles (e.g., article 102 of FIG. 1) from a retail store facility (e.g., retail store facility 150 of FIG. 1). The retail transaction application can be a pre-installed application, add-on application, or a plug-in application. The retail transaction application can be downloaded to the MCD via a website or other electronic data transfer means prior to step 806. In some scenarios, the retail transaction application is launched in response to a user-software interaction. For example, the retail transaction application is launched in response to a customer interaction with a product via a barcode scan, an NFC scan, QR code scan of a price tag or product ID tag. In other scenarios, the retail transaction application is launched automatically in response to user authentication.

Thereafter, the MCD receives a user input to start a retail transaction process for purchasing an article (e.g., article 102 of FIG. 1). In this regard, a GUI can be presented to the user of the MCD. The GUI may include a prompt for a user-software interaction for beginning a retail purchase process. Upon completing step 808, step 810 is performed where the MCD and/or the PD obtains article information that is useful for purchasing the article. The article information can include, but is not limited to, an article identifier, an article purchase price, and/or a security tag identifier. The MCD can obtain article information via a user-software interaction therewith. In contrast, the PD can obtain the article information via an SRC. The SRC can include, but is not limited to, a barcode communication (e.g., barcode communication 122 of FIG. 1) or an NFC communication (e.g., NFC communication 120 of FIG. 1). Notably, the PD performs operations for obtaining the article information in accordance with instructions and/or commands received from the MCD via an SRC (e.g., a Bluetooth communication). Also, the PD may forward the obtained article information to the MCD via the SRC.

Upon receiving the article information at the MCD, an optional step 812 is performed where payment information is input into the retail transaction application. The payment information can be input into the retail transaction software via a user-software interaction with the MCD or an SRC (e.g., a barcode scan or a payment card scan) with the PD. In the SRC scenario, the payment information is forwarded from PD to MCD via another SRC (e.g., a Bluetooth communication). The payment information can include, but is not limited to, a customer loyalty code, payment card information, and/or payment account information. Alternatively or additionally, step 812 can involve activating a one-click ordering process where the customer payment information is stored online so that the customer does not have to present a credit card or swipe the card to tender the transaction. Once the one-click ordering process is activated, the user of the MCD can simply press a key on a keypad or touch a button on a touch screen of the MCD for tendering the transaction.

In a next step 814, the MCD performs operations for establishing a retail transaction session with an RTS (e.g., RTS 118 of FIG. 1). Subsequently, step 816 is performed where the article information and payment information is communicated from the MCD to the RTS via a public network (e.g., public network 106 of FIG. 1). At the RTS, the article information and the payment information is processed, as shown by step 818. This information is processed by the RTS to complete a purchase transaction.

Once the purchase transaction is completed, step 820 is performed where a response message is generated by the RTS. The response message indicates whether the articles have been successfully or unsuccessfully purchased. The response message is then communicated in step 822 from the RTS to the MCD. Thereafter, a decision step 824 is performed where the MCD determines if the articles were successfully purchased. This determination can be made based on the contents of the response message. If the articles were not successfully purchased [824:NO], then step 826 is performed where the method 800 ends or other processing is performed. In contrast, if the articles were successfully purchased [824: YES], then steps 828-830 are performed. Step 828 involves starting a security tag detaching process automatically by the MCD, automatically by the RTS, or in response to a user-software interaction with the MCD. An exemplary security tag detachment process will be described below in relation to FIGS. 9A-9E. Subsequent to completing step 828, step 830 is performed where the method 800 ends or other processing is performed.

Referring now to FIGS. 9A-9E, there is provided an exemplary security tag detachment process 900 that is useful for understanding the present invention. Process 900 begins with step 902 and continues with step 904. Step 904 involves displaying a GUI to the user of the MCD (e.g., MCD 104 of FIG. 1). The GUI enables the user to start a process for removing a security tag (e.g., security tag 132 of FIG. 1) from an article (e.g., article 102 of FIG. 1). Once the process has been initialized, step 905 is performed where the MCD determines whether or not a PD (e.g., PD 190 of FIG. 1) thereof is ready to deactivate the security tag.

In some scenarios, step 905 involves performing operations by the MCD to communicate a ping message to the PD via an SRC (e.g., a Bluetooth communication). The ping message may take the form of more or less complexity, but the basic purpose of the ping message is for the MCD to determine whether or not the PD is powered and ready, as well as determine the state of the PD. The term "state", as used here, means the location of control in a state machine algorithm used to control the behavior of an internal controller (e.g., controller 406 of FIG. 4). That is, a state machine with discretely numbered states would be implemented as executable code on the internal controller, and particular algorithms would be implemented as specific states in that state machine. The state machine might also include functions (e.g., power checking functions and security functions) not related to such algorithms. When the MCD pings the PD, the PD responds with a response message indicating its state (i.e., giving its current state identification code or number). The response message may be communicated from the PD to the MCD via an SRC (e.g., a Bluetooth communication). If the PD is ready, the MCD may wait for an event message from the PD. The invent message includes information (e.g., article information) indicating that a particular security tag may need to be deactivated. In contrast, of the PD is not ready, then the MCD may wait for a pre-defined period of time to expire, and thereafter re-ping the PD.

Next, process 900 continues with optional steps 906-910. Optional steps 906-910 can be performed when the article information obtained from the article is absent of a security tag identifier. If the article information includes the security tag identifier, then process 900 may be absent of at least steps 906-910.

In optional step 906, a user (e.g., customer 140 of FIG. 1 or sales associate 142 of FIG. 1) places a PD (e.g., PD 190 of FIG. 1) of the MCD in proximity of a security tag (e.g., security tag 132 of FIG. 1). Consequently, the MCD may optionally control the PD so that it performs operations to detect any active security tags on the article. Such operations can be performed by a tag detection system (e.g., tag detection system 418 of FIG. 4) of the PD using SRCs (e.g., barcode communications, RFID communications, NFC communications, and/or Bluetooth communications).

When at least one active security tag has been detected, the PD performs optional step 908. In step 908, the PD obtains at least a unique identifier from the security tag via an SRC (e.g., a barcode communication, an RFID communication, an NFC communication, and/or a Bluetooth communication). An event message including the unique identifier is then communicated from PD to MCD via another SRC (e.g., a Bluetooth communication). In some scenarios, this SRC is initiated by the PD, but in other scenarios the second SRC is initiated by the MCD via a polling process. An indication is provided to the user of the MCD indicating that the unique identifier has been successfully obtained from the security tag, as shown by optional step 910.

In response to the reception of the event message, the MCD performs various operations to determine whether or not the particular security tag should be deactivated. For example, as shown by optional step 911, the MCD may perform operations to determine whether or not a deactivation energy pulse would likely interfere with other devices (e.g., an EAS tag detection pedestal) running in the retail store. If it is determined that such a deactivation energy pulse is unlikely to interfere with the operations of other devices in the retail store, then process 900 may continue with step 912, otherwise process 900 may end or return to a previous step.

In step 912, the MCD obtains a telephone number, an electronic address (e.g., an Internet Protocol ("IP") address) of a computing device (e.g., computing device 108 of FIG. 1) of an RTS (e.g., RTS 118 of FIG. 1), and/or an electronic mail address of the user of the RTS computing device. The telephone number, electronic address and/or electronic mail address can be obtained from the user of the MCD or from a directory stored in a data store (e.g., memory 312 of FIG. 3) of the MCD.

The telephone number or the electronic address is then used in step 914 to establish a communication link between the MCD and RTS computing device. The communication link can include, but is not limited to, an RF communication link (e.g., RF communication link 124 of FIG. 1). In some scenarios, the MCD and/or the RTS computing device comprise a tablet computer or a mobile phone employing smart technology. Such tablet computers and mobile phones are referred to in the art as Smart devices. Smart devices are well known in the art, and therefore will not be described herein.

Additionally or alternatively, step 914 can involve sending electronic mail to the user of the RTS computing device indicating that an access request has been made. In this scenario, the electronic mail may include, but is not limited to, a means for launching an application for granting/denying the access request, a unique identifier of the security tag, a unique identifier of the object/item being secured by the security tag, a unique identifier of the user of the MCD (e.g., a user name), and/or a unique identifier of the MCD (e.g., a telephone number).

Upon completing step 914, optional step 916 is performed. Optional step 916 can be performed if a communication link was established between the MCD and RTS computing device in step 914 via the telephone number or electronic address. Optional step 916 may not be performed where electronic mail is employed in step 914.

In optional step 916, a first message is communicated from the MCD to the RTS computing device. The first message may indicate that a user of the MCD is requesting detachment of a security tag from an article. In this regard, the message can include, but is not limited to, a unique identifier of the security tag, a unique identifier of the article being secured by the security tag, a unique identifier of the user of the MCD (e.g., a user name), and/or a unique identifier of the MCD (e.g., a telephone number). In some scenarios, the first message is a text message or a pre-recorded voice message.

Thereafter, the process 900 continues with step 918. Step 918 involves launching a pre-installed application, add-on application and/or a plug-in application of the RTS computing device. The application can be launched in response to receiving the first message from the MCD or the electronic mail message from the MCD. The pre-installed application, add-on application, and/or plug-in application can be automatically launched in response to the reception of the first message or electronic mail message. Alternatively, the pre-installed application, add-on application, and/or plug-in application can be launched in response to a user-software interaction. The pre-installed application, add-on application, and/or plug-in application is configured to facilitate control of access to the area and/or object. An audible indication may also optionally be emitted from the RTS computing device in response to the reception of the first message or electronic mail thereat, as shown by step 920.

Next, an optional decision step 922 is performed to determine if the security tag is allowed to be detached from the article. This determination can be made using the information contained in the received message (i.e., the first message or the electronic mail message) and/or information stored in a data store of the RTS. For example, it may be determined that the security tag is allowed to be detached from the article when (a) the article has been successfully purchased and/or (b) an identifier of the user and/or MCD match that stored in the data store of the RTS. Alternatively or additionally, such a determination can be made when a classification level assigned to the user is the same as that of the article being secured by the security tag. The classification level can include, but is not limited to, a retail floor personnel, a retail store manager, a retail store owner, a privileged customer, a secret level, a top secret level, a classified level, and/or an unclassified level.

Figure 9B:
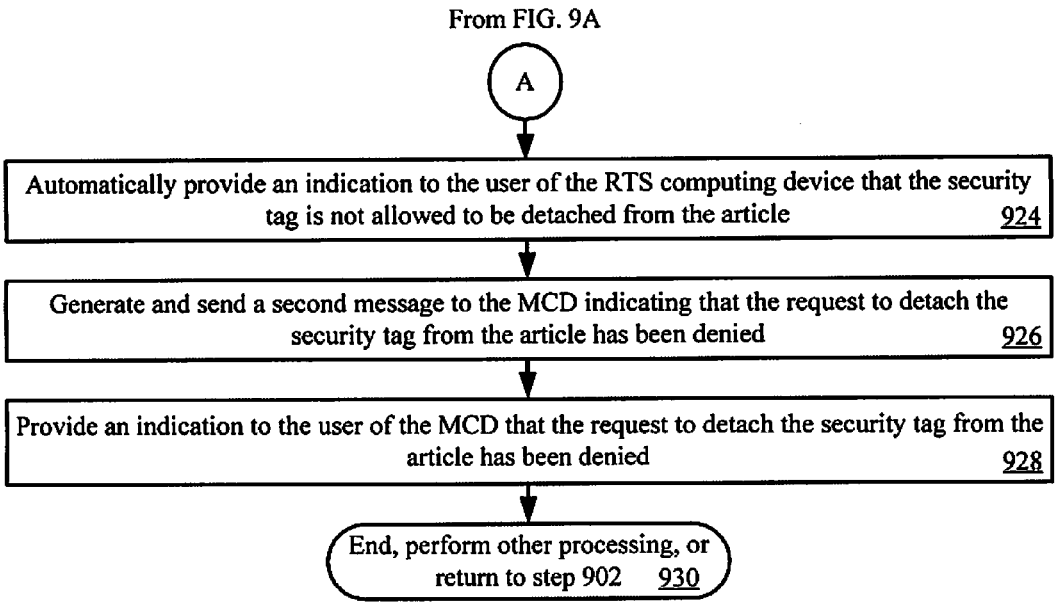

If it is determined that the security tag is not allowed to be removed from the article [922:NO], then the process 900 continues with steps 924-930 of FIG. 9B. Step 924 involves automatically providing an indication to the user of the RTS computing device that the security tag is not allowed to be detached from the article. Also, a second message is generated and sent to the MCD indicating that the user's request to detach the security tag from the article has been denied, as shown by step 926. Upon receipt of the second message at the MCD, an indication is provided to the user thereof that his/her request has been denied. Subsequently, step 930 is performed where the process 900 ends, other processing is performed, or the process 900 returns to step 902.

If it is determined that the user of the security tag is allowed to be detached from the article [922:YES], then the process 900 continues with step 932 of FIG. 9C. As shown in FIG. 9C, step 932 involves automatically displaying information to the user of the RTS computing device which indicates that the user of the MCD is requesting detachment of a security tag from an article. In this regard, the displayed information can include, but is not limited to, information identifying the user of the MCD, information identifying the MCD, contact information for the user and/or MCD, information identifying the article, information identifying the security tag, and/or information indicating that a security tag detachment is being requested. Thereafter, an optional step 934 is performed for obtaining a verbal confirmation from the user of the MCD that (s)he is seeking detachment of the security tag from the article.

In a next step 936, the RTS computing device performs operations to obtain a detachment key or code from a data store that is associated with the identifier of the article and/or the identifier of the security tag. If a detachment code is obtained in step 936, then an optional step 938 may be performed where the detachment key is generated by the RTS computing device. In a next step 940, the detachment key or code is communicated from the RTS computing device to the MCD. If the MCD receives the detachment code, then it may generate the detachment key using the detachment code, as shown by optional step 942.

Once the MCD possesses the detachment key, a decision is made in optional step 944 to determine if the detachment key is a one-time-only use key. If it is determined that the detachment key is not a one-time-only use key [944:NO], then steps 946-952 are performed. Step 946 involves communicating a trigger message including the detachment key from the MCD to the PD via an SRC (e.g., a Bluetooth communication). The MCD may also initialize a counter to zero such that it can wait a pre-defined period of time for a response message from PD indicating that the security tag has been successfully or unsuccessfully detached or deactivated.

At the PD, operations are performed to detach or deactivate the security tag. An exemplary method of the PD operations for detaching or deactivating an electro-mechanical security tag will be described in detail below in relation to FIG. 10. Still, it should be understood that such operations generally involve: communicating a signal to the security tag for causing it to open an electronic lock, remove a tack/pin/lanyard, and/or heat an adhesive using the detachment key; receiving information from the security tag indicating whether or not the electronic lock was successfully unlocked, the tack/pin/or lanyard was successfully removed, and/or the adhesive was successfully heated; and/or forwarding such information in a response message from the PD to the MCD.

If the MCD does not receive the response message within the pre-defined period of time [950:NO], then the MCD reports to the user and/or RTS that the security tag detachment/deactivation failed. In contrast, if the MCD does receive the response message within the pre-defined period of time [950:YES], then the MCD reports to the user and/or RTS that the security tag detachment/deactivation was successful. Upon completing step 952 or 954, step 956 is performed where the process 900 ends, other processing is performed, or the process 900 returns to step 902.

Figure 9D:
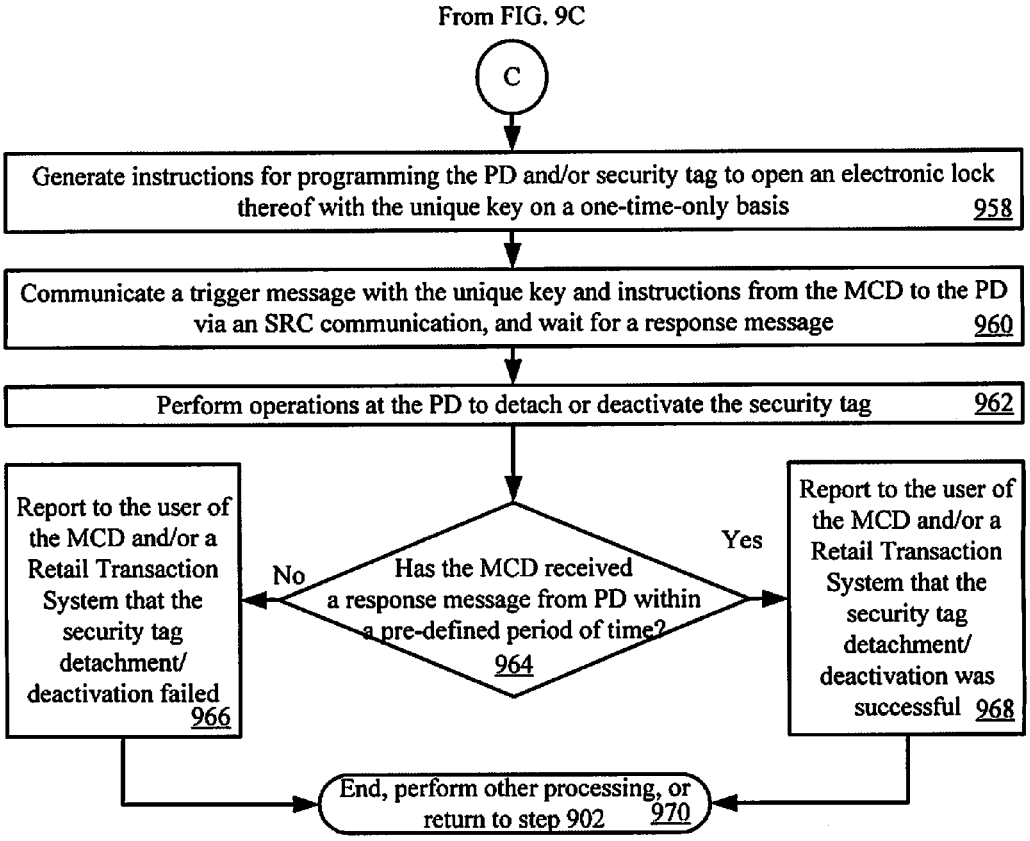
Figure 9E:
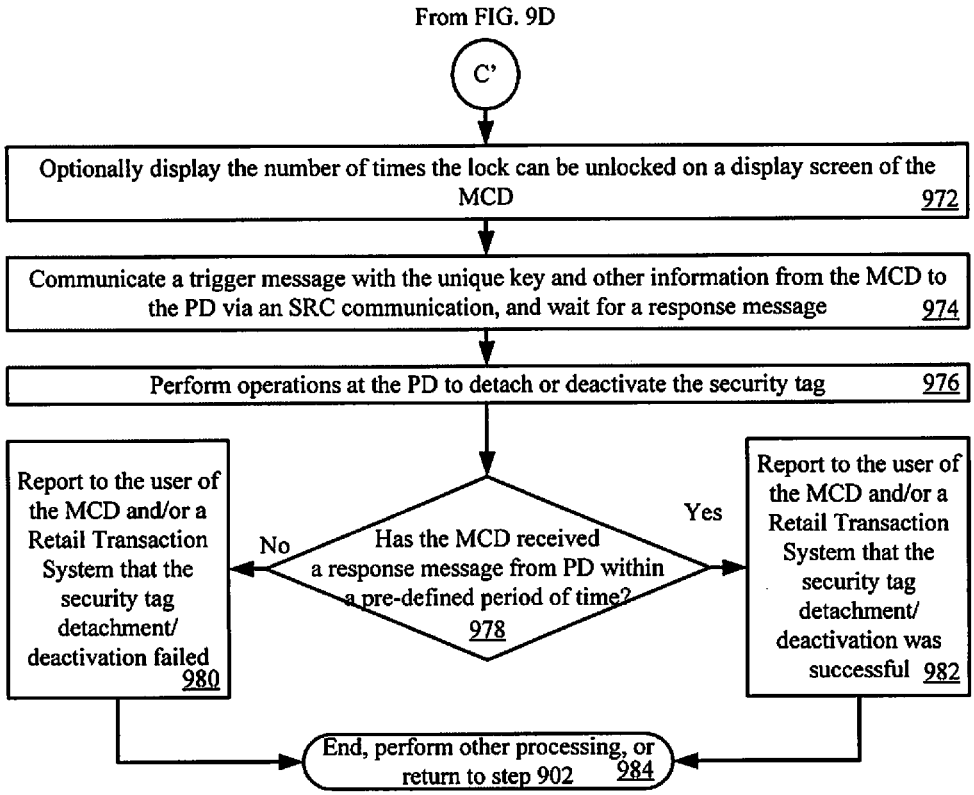

If it is determined that the detachment key is a one-time-only use key [944:YES], then the process 900 continues with steps 958-970 of FIG. 9D or steps 972-984 of FIG. 9E, depending on the particular application. As shown in FIG. 9D, step 658 involves generating instructions for programming the PD and/or security tag to open an electronic lock, remove a tack/pin/lanyard, and/or heat an adhesive using the detachment key on a one-time-only basis. A trigger message with the detachment key and the instructions is then sent in step 660 from the MCD to the PD via an SRC (e.g., an NFC communication). The MCD may also initialize a counter to zero such that it can wait a pre-defined period of time for a response message from PD indicating that the security tag has been successfully or unsuccessfully detached or deactivated.

At the PD, operations are performed to detach or deactivate the security tag using the instructions and/or detachment key. An exemplary method of the PD operations for detaching or deactivating an electro-mechanical security tag will be described in detail below in relation to FIG. 10. Still, it should be understood that such operations generally involve: communicating a signal to the security tag for causing it to open an electronic lock, remove a tack/pin/lanyard, and/or heat an adhesive using the detachment key using the instructions and/or detachment key; receiving information from the security tag indicating whether or not the electronic lock was successfully unlocked, the tack/pin/lanyard was successfully removed, and/or the adhesive was successfully heated; and/or forwarding such information in a response message from the PD to the MCD.

If the MCD does not receive the response message within the pre-defined period of time [964:NO], then the MCD reports to the user and/or RTS that the security tag detachment/deactivation failed. In contrast, if the MCD does receive the response message within the pre-defined period of time [964:YES], then the MCD reports to the user and/or RTS that the security tag detachment/deactivation was successful. Upon completing step 966 or 968, step 970 is performed where the process 900 ends, other processing is performed, or the process 900 returns to step 902.

As shown in FIG. 6E, step 672 involves optionally displaying the number of times the lock can be unlocked, a tack/pin/lanyard can be released/removed, and/or an adhesive can be heated using the detachment key on a display screen of the MCD. In a next step 674, the MCD simply forwards the information received from RTS to PD without modification. The information can include, but is not limited to, a detachment key/code, time out information, and/or information specifying the number of times the detachment key/code can be used. The information can be sent in one or more transmissions from the MCD to the PD.

At the PD, operations are performed to detach or deactivate the security tag using the detachment key and/or other information. An exemplary method of the PD operations for detaching or deactivating an electro-mechanical security tag will be described in detail below in relation to FIG. 10. Still, it should be understood that such operations generally involve: communicating a signal to the security tag for causing it to open an electronic lock, remove a tack/pin/lanyard, and/or heat an adhesive using the detachment key using the instructions and/or detachment key; receiving information from the security tag indicating whether or not the electronic lock was successfully unlocked, the tack/pin/lanyard was successfully removed, and/or the adhesive was successfully heated; and/or forwarding such information in a response message from the PD to the MCD.

If the MCD does not receive the response message within the pre-defined period of time [978:NO], then the MCD reports to the user and/or RTS that the security tag detachment/deactivation failed. In contrast, if the MCD does receive the response message within the pre-defined period of time [978:YES], then the MCD reports to the user and/or RTS that the security tag detachment/deactivation was successful. Upon completing step 980 or 982, step 984 is performed where the process 900 ends, other processing is performed, or the process 900 returns to step 902.

As noted above, the security tag can be placed in a collection bin once it has been detached from the article. Thereafter, the security tag can be attached to another article. In this regard, the electronic lock of the security tag can be locked in response to the reception of a locking code from an external device (e.g., PD 190 of FIG. 1, MCD 104 of FIG. 1 or RTS 118 of FIG. 1). Also, the security tag can send a response message to the external device indicating that the electronic lock has been once again locked. This locking process can be triggered by another read of the unique identifier (e.g., unique identifier 210 of FIG. 2) stored in the security tag. Alternatively or additionally, the electronic lock, tack, pin and/or lanyard can be secured automatically when the time expires as specified by the time limit information received from the external device. Also, a timeout mechanism of the security tag can start after pre-determined time period programmed in the security tag has expired.

Figure 10:
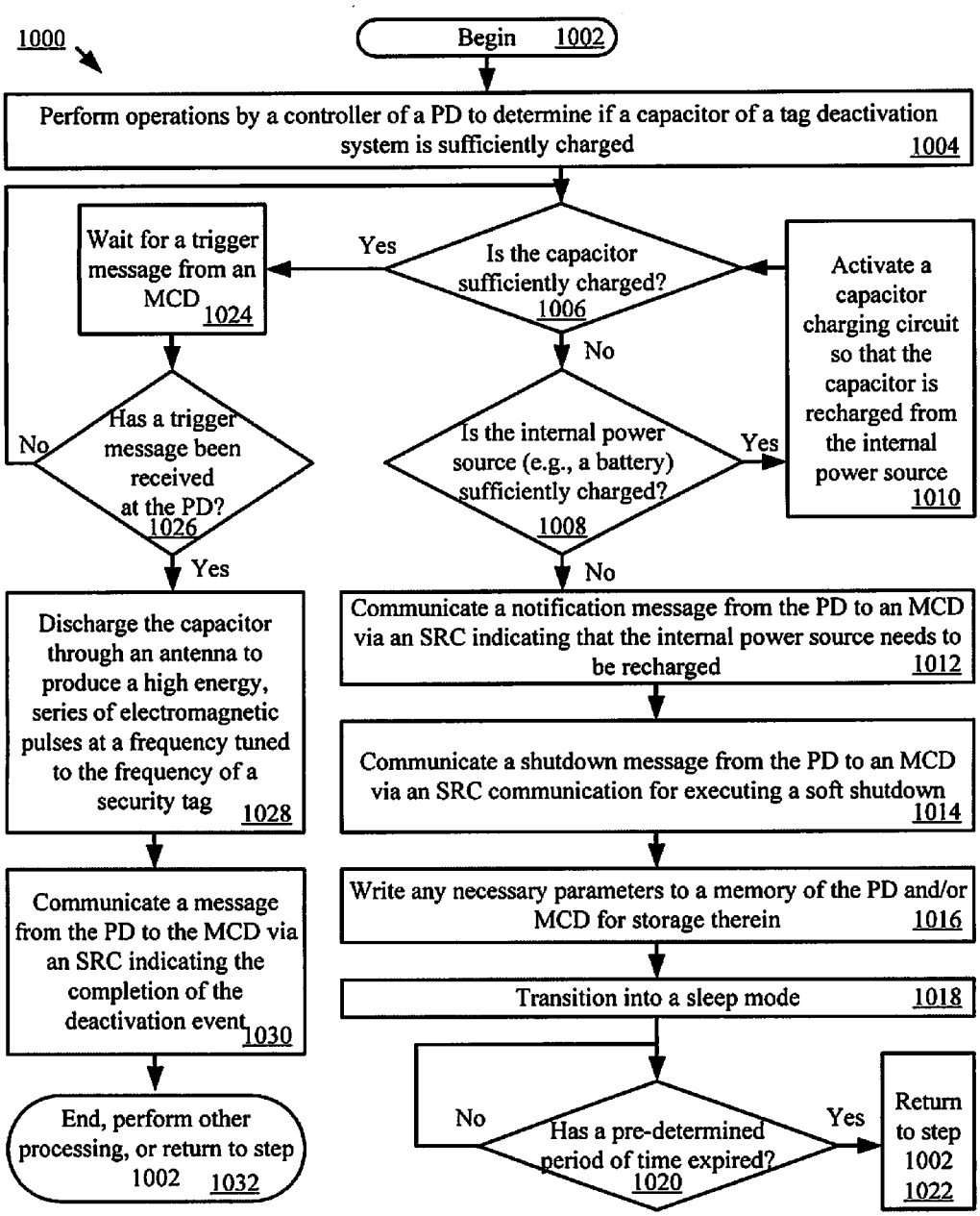
FIG. 10 is a flow diagram of an exemplary process for detaching or deactivating an electro-mechanical security tag using a peripheral device of a mobile communication device.

Referring now to FIG. 10, there is provided a flow diagram of an exemplary process 1000 for detaching or deactivating an electro-mechanical security tag using a PD (e.g., PD 190 of FIG. 1) of an MCD (e.g., MCD 104 of FIG. 1). More specifically, process 1000 is the basic control algorithm which can be executed by a controller (e.g., controller 406 of FIG. 4) of the PD to control the operations of the tag deactivation system (e.g., tag deactivation system 420 of FIG. 4) of the PD.

As shown in FIG. 10, process 1000 begins with step 1002 and continues with step 1004. Step 1004 involves performing operations by a controller of a PD to determine if a capacitor (e.g., capacitor 512 of FIG. 5) of a tag deactivation system (e.g., system 420 of FIG. 4) is sufficiently charged. For example, the PD determines whether the capacitor is charged to a voltage at or above a minimum effective charge level. If the capacitor is sufficiently charged [1006:YES], then steps 1024-1032 are performed. Steps 1024-1032 will be described below. In contrast, if the capacitor is not sufficiently charged [1006:NO], then steps 1008-1022 are performed.

As shown in FIG. 10, step 1008 is a decisions step in which it is determined whether an internal power source (e.g., internal power source 430 of FIG. 4) of the PD is sufficiently charged (e.g., has a voltage level above a threshold voltage level). If the internal power source is sufficiently charged [1008:YES], then a capacitor charging circuit (e.g., circuit 504 of FIG. 5) is activated so that the capacitor is recharged from the internal power source, as shown by step 1010. In this regard, step 1010 involves closing a switch (e.g., switch 508 of FIG. 5). Thereafter, process 1000 returns to step 1006. In contrast, of the internal power source is not sufficiently charged [1008:NO], then step 1012 is performed where a notification message is communicated from the PD to the MCD via an SRC (e.g., a Bluetooth communication). The notification message indicates that the internal power source needs to be recharged. Subsequently, a shutdown message is communicated from the PD to the MCD via an SRC (e.g., a Bluetooth communication) for executing a soft shutdown, as shown by step 1014. In a next step 1016, any necessary parameters are written to a memory (e.g., memory 412 of FIG. 4) of the PD and/or a memory (e.g., 312 of FIG. 3) of the MCD for storage therein. The PD then transitions into a sleep mode, as shown by step 1018. In sleep mode, the PD waits for a pre-determined period of time to expire. In this regard, a low power time is running within the PD during sleep mode. When the pre-determined period of time has expired [1020:YES], process 100 returns to step 1002, as shown by step 1022.

As also shown in FIG. 10, the PD waits for a trigger message from the MCD as shown by steps 1024 and 1026. When the trigger message is received by the PD [1026:YES], then steps 1028-1032 are performed. In step 1028, the capacitor is discharged through an antenna (e.g., antenna 516 of FIG. 5) thereby producing a high, energy series of electromagnetic pulses at a frequency tuned to the frequency of a security tag. Next, a message is communicated in step 130 from the PD to the MCD via an SRC (e.g., a Bluetooth communication). The message indicates the completion of the deactivation event. Subsequently, step 1032 is performed where process 1000 ends, other processing is performed, or process 1000 returns to step 1002.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A method for operating a security tag of an Electronic Article Surveillance ("EAS") system, comprising:

executing on a mobile Point Of Sale ("POS") device an application controlling operations of a peripheral device mechanically attached to the mobile POS device such that the mobile POS and peripheral device are able to be collectively and easily carried or worn by a user, where the peripheral device facilitates performance of a purchase transaction;

receiving, by a mobile POS device, a request to detach the security tag from an article;

in response to the request, communicating a message from the mobile POS device to the peripheral device via a first short range communication, the message configured to cause the peripheral device to perform operations to facilitate a detachment of the security tag from the article; and performing operations by the peripheral device to cause an actuation of a detachment mechanism of the security tag or a heating of an adhesive disposed on the security tag.

2. The method according to claim 1, wherein the first short range communication is a Bluetooth communication.

3. The method according to claim 1, wherein the peripheral device wraps around at least a portion of the mobile POS device.

4. The method according to claim 1, further comprising obtaining access to a secure area of a retail store by communicating a second short range communication from the peripheral device.

5. The method according to claim 1, further comprising obtaining access to heavy equipment by communicating a second short range communication from the peripheral device.

6. The method according to claim 1, further comprising:

obtaining, by the peripheral device, article information for the article via a second short range communication; and forwarding the article information from the peripheral device to the mobile POS device via a third short range communication.

7. The method according to claim 1, further comprising:

obtaining payment information for the article using an electronic card reader or a short range communication unit of the peripheral device; and forwarding the payment information from the peripheral device to the mobile POS device via a second short range communication.

8. The method according to claim 1, further comprising communicating retail item information or receipt information from the peripheral device to a mobile communication device via a second short range communication.

9. The method according to claim 1, further comprising:

obtaining, by the peripheral device, a unique identifier for the security tag via a second short range communication; and forwarding the unique identifier from the peripheral device to the mobile POS device via a third short range communication.

10. The method according to claim 9, wherein the second short range communication is a barcode communication or a near field communication.

11. A Electronic Article Surveillance ("EAS") system, comprising:

a security tag attached to an article;

a mobile Point Of Sale ("POS") device configured to:

control operations of a peripheral device for facilitating performance of a purchase transaction, and receive a request to detach the security tag from the article; and the peripheral device mechanically coupled to the mobile POS device such that the mobile POS device and the peripheral device are able to be collectively and easily carried or worn by a user, where the peripheral device receives a message, from the mobile POS device via a first short range communication, that is configured to cause the peripheral device to perform operations to facilitate a detachment of the security tag from the article, and performs operations to cause an actuation of a detachment mechanism of the security tag or a heating of an adhesive disposed on the security tag.

12. The system according to claim 11, wherein the first short range communication is a Bluetooth communication.

13. The system according to claim 11, wherein the peripheral device wraps around at least a portion of the mobile POS device.

14. The system according to claim 11, wherein the peripheral device is further configured to communicate a second short range communication therefrom to make a secure area of a retail store accessible to a store associate.

15. The system according to claim 11, wherein the peripheral device is further configured to communicate a second short range communication therefrom to make heavy equipment accessible to a store associate.

16. The system according to claim 11, wherein the peripheral device is further configured to:

obtain article information for the article via a second short range communication, and forward the article information to the mobile POS device via a third short range communication.

17. The system according to claim 11, wherein the peripheral device is further configured to:

obtain payment information for the article using an electronic card reader or a short range communication unit of the peripheral device, and forward the payment information to the mobile POS device via a second short range communication.

18. The system according to claim 11, wherein the peripheral device is further configured to communicate retail item information or receipt information to a mobile communication device via a second short range communication.

19. The system according to claim 11, wherein the peripheral device is further configured to:

obtain a unique identifier for the security tag via a second short range communication; and forward the unique identifier to the mobile POS device via a third short range communication.

20. The system according to claim 19, wherein the second short range communication is a barcode communication or a near field communication.

* * * * *